US006517065B2

(12) United States Patent
Miyake et al.

(10) Patent No.: US 6,517,065 B2
(45) **Date of Patent: *Feb. 11, 2003**

(54) SHEET PROCESS DEVICE ONCE STACKING RECEIVED SHEETS ON FIRST STACK MEANS AND THEN TRANSFERRING THEM TO SECOND STACK MEANS

(75) Inventors: Norifumi Miyake, Kashiwa (JP); Chikara Sato, Hachioji (JP); Yasuo Fukazu, Abiko (JP); Masatoshi Yaginuma, Toride (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/178,481

(22) Filed: Oct. 26, 1998

(65) Prior Publication Data

US 2002/0014733 A1 Feb. 7, 2002

(30) Foreign Application Priority Data

Oct. 27, 1997 (JP) ..... 9-311401

(51) Int. Cl.[7] ..... B65H 33/04

(52) U.S. Cl. ..... 270/58.09; 270/58.12; 270/58.19; 270/58.21; 270/58.22; 414/789.9

(58) Field of Search ..... 414/789.9; 270/58.12, 270/58.21, 58.22, 58.17

(56) References Cited

U.S. PATENT DOCUMENTS 5,042,793 A * 8/1991 Miyake ..... 271/293
5,112,034 A * 5/1992 Uto et al. ..... 270/58.12
5,137,265 A * 8/1992 Sato et al. ..... 270/58.12
5,299,795 A * 4/1994 Miyake ..... 271/9.02
5,390,016 A * 2/1995 Hoshi et al. ..... 399/371
5,556,251 A * 9/1996 Hiroi et al. ..... 414/790.3
5,592,280 A * 1/1997 Ishizuka et al. ..... 399/410
5,622,359 A * 4/1997 Kawano et al. ..... 270/58.12
5,639,080 A * 6/1997 Evans ..... 270/58.28
5,765,824 A * 6/1998 Kawano et al. ..... 270/58.11
5,772,197 A * 6/1998 Aoki et al. ..... 270/58.08
5,772,198 A * 6/1998 Yamamoto ..... 270/58.12
5,931,460 A * 8/1999 Kadowaki et al. ..... 271/220
5,971,383 A * 10/1999 Horikawa et al. ..... 270/58.11

FOREIGN PATENT DOCUMENTS

JP 8-91686 4/1996
JP 9-221260 8/1997
JP 9-235069 9/1997

* cited by examiner

*Primary Examiner*—Donald P. Walsh
*Assistant Examiner*—Jeffery A Shapiro
(74) *Attorney, Agent, or Firm*—Fitzpatrick, Cella, Harper & Scinto

(57) ABSTRACT

The present invention provides a sheet process device capable of performing a sheaf discharge operation to discharge sheaves of sheets stacked on a process tray to a stack tray, without discharging a next sheet to the process tray during the sheaf discharge operation and stopping an operation on a body side of an image formation apparatus. In the sheet process device, for example, in a case where an original consisting of six sheets of paper is carried, the first to third sheets are stacked on the process tray as they are without any designation, and the following fourth sheet is designated as a sheaf discharge sheet since it is the sheet two before the final sheet of the sheaf, whereby the sheaf discharge of the first to fourth sheets is performed. The fifth sheet after the sheaf discharge is designated as a wind sheet since a value of a wind counter has been set to be "2". Then, when the fifth sheet is stacked on the process tray together with the sixth sheet designated as the final sheet of the sheaf, the sheaf discharge is performed.

25 Claims, 24 Drawing Sheets

SHEET PROCESS DEVICE ONCE STACKING RECEIVED SHEETS ON FIRST STACK MEANS AND THEN TRANSFERRING THEM TO SECOND STACK MEANS

BACKGROUND OF THE INVENTION

1. Field of the Invention

The present invention relates to a sheet process device which once stacks received sheets of paper (simply referred as "sheets" hereinafter) on a first stack means and then shifts the stacked sheets to a second stack means.

2. Related Background Art

Conventionally, a device consisting of a combination of a process tray and a stack tray has been known as a sheet process device used in an image formation apparatus such as a copy machine, a printer or the like. On the process tray, sheets are stapled according to necessity. On the stack tray, sheets are received and stacked each sheaf.

In this sheet process device, a stapler to staple the sheets and a jogger to adjust or align the sheets with movement in front and rear directions are provided on the periphery of the process tray. Sheaves of sheets are adjusted on the process tray, the adjusted sheaves are respectively stapled, and the stapled sheaves are then discharged to the stack tray by a pair of sheaf discharge rollers.

Then, the stack tray is moved in forward and reverse directions (i.e., sheet-width direction) for each sheaf to sort over the sheaves of sheets. Moreover, the stack tray can be moved in upward and downward directions to fit a sheet face to the discharge roller.

However, the conventional sheet process device has following problems, and thus solutions for these problems have been earnestly expected. That is, in case of discharging the sheaf of sheets (paper) not yet stapled, if such the sheaves stacked on the process tray in large quantities are discharge at a time, the sheaves of sheets on the stack tray are off the alignment, whereby it becomes difficult to sort the sheets.

Further, in order to avoid a situation that, while the sheaves of sheets not stapled yet and stacked on the process tray are discharged to the stack tray, next or following sheets are fed to the process tray, it is necessary to temporarily stop an operation of the image formation apparatus itself during the sheet discharge operation.

SUMMARY OF THE INVENTION

An object of the present invention is to provide a sheet process device which can solve the above conventional drawbacks.

Another object of the present invention is to provide a sheet process device in which sheaves of sheets can be discharged without the sheaves stacked on the stack tray being off the alignment.

Still another object of the present invention is to provide a sheet process device in which sheaves of sheets stacked on a process tray can be discharged to a stack tray without next or following sheets being fed to the process tray while the current sheets on the process tray are discharged and without an image formation apparatus itself being stopped.

In one embodiment, the sheet process device of the present invention comprises first stack means for stacking thereon discharged sheets, binding process means for performing a binding process on the sheets stacked on the first stack means, second stack means for stacking thereon the sheets transferred from the first stack means, and a transfer unit for transferring the sheets from the first stack means to the second stack means. In addition, the device comprises transfer control means for driving the transfer unit in a case where a last sheet of one group is stacked on the first stack means in a mode to perform the binding process by the binding process means, and for driving the transfer unit in a case where a predetermined number of sheets are stacked on the first stack means and where the last sheet of the group is stacked on the first stack means in a mode not to perform the binding process by the binding process means.

In another embodiment, the sheet process device of the present invention comprises stagnation means for stagnating received sheets, first stack means for stacking thereon the sheets, carrier means for carrying the sheets to the first stack means without stagnating them in the stagnation means, and carrying the sheets to the first stack means after stagnating them in the stagnation means, and second stack means for stacking thereon the sheets transferred from the first stack means. Further, the device includes a transfer unit for transferring the sheets from the first stack means to the second stack means, transfer control means for driving the transfer unit in a case where a predetermined number of sheets are stacked on the first stack means and where a last sheet of one group is stacked on the first stack means, and carrier control means for controlling the carrier means to cause the stagnation means to stagnate the sheets in a case where the transfer unit starts the sheet transfer. Additionally, the transfer control means drives the transfer unit in a case where a third last sheet of the group is stacked on the first stack means.

In yet another embodiment, the sheet process device of the present invention comprises stagnation means capable of stagnating B sheets received, first stack means for stacking thereon the sheets, carrier means for carrying the sheets to the first stack means without stagnating them in the stagnation means, and carrying together with newly received sheets the sheets to the first stack means after stagnating at least one of the sheets in the stagnation means, and second stack means for stacking thereon the sheets transferred from the first stack means. Further, the device includes a transfer unit for transferring the sheets from the first stack means to the second stack means, transfer control means for driving the transfer unit in a case where a predetermined number of sheets are stacked on the first stack means and where a last sheet of one group is stacked on the first stack means, and carrier control means for controlling the carrier means to cause the stagnation means to stagnate the sheets in a case where the transfer unit starts the sheet transfer. Additionally, the transfer control means drives the transfer unit when any one of the sheets B+1 to two-before-a-final-one of the sheets constituting the group is stacked on the first stack means.

In still yet another embodiment, the sheet process device of the present invention comprises stagnation means capable of stagnating B sheets received, first stack means for stacking thereon the sheets, carrier means for carrying the sheets to the first stack means without stagnating them in the stagnation means, and carrying the sheets together with newly received sheets to the first stack means after stagnating at least one of the sheets in the stagnation means, and second stack means for stacking thereon the sheets transferred from the first stack means. Further, the device includes a transfer unit for transferring the sheets from the first stack means to the second stack means, transfer control means for driving the transfer unit in a case where a predetermined number of sheets are stacked on the first stack means and where a last sheet of one group is stacked on the first stack means, and carrier control means for controlling the carrier means to cause the stagnation means to stagnate the sheets in a case where the predetermined number of sheets are stacked on the first stack means and where the last sheet of the group is stacked on the first stack means. Additionally, the carrier control means controls the carrier means to cause the stagnation means to stagnate at least a second last sheet of the group, irrespective of the carrier control.

In still yet another embodiment, the sheet process device of the present invention comprises first stack means for stacking thereon discharged sheets, second stack means for stacking thereon the sheets transferred from the first stack means, and a transfer unit for transferring the sheets from the first stack means to the second stack means. Further, the device includes transfer control means for driving, when a size of the sheet is equal to or smaller than a predetermined size, the transfer unit in a case where a first predetermined number of sheets are stacked on the first stack means, and for driving, when the size of the sheet is larger than a predetermined size, the transfer unit in a case where a second predetermined number of sheets smaller than the first predetermined number of sheets are stacked on the first stack means.

In still yet another embodiment, the sheet process device of the present invention comprises a transfer unit for performing sheet transferring from a first storage unit to a second storage unit, the first storage unit capable of storing plural sheets in a binding process to the sheets and plural sheets in a non-binding mode not to perform the binding process, and controlling means for controlling the transfer unit. In addition, in a case where an operation mode is the binding mode, the controlling means causes the transfer unit not to perform the sheet transferring before all the sheets included in one group are stored in the first storage unit, but to perform the sheet transferring after all the sheets included in the one group are stored in the first storage unit. Further, in a case where the operation mode is the non-binding mode, the controlling means causes the transfer unit to perform the sheet transferring before all the sheets included in the one group are stored in the first storage unit.

In still yet another embodiment, the present invention provides a control method for a sheet process device which comprises a transfer unit for performing sheet transferring from a first storage unit to a second storage unit, the first storage unit capable of storing plural sheets in a binding mode to perform a binding process to the sheets and plural sheets in a non-binding mode not to perform the binding process. More specifically, the method comprises a controlling step of controlling the transfer unit, wherein, in a case where an operation mode is the binding mode, the controlling step causes the transfer unit not to perform the sheet transferring before all the sheets included in one group are stored in the first storage unit, but to perform the sheet transferring after all the sheets included in the one group are stored in the first storage unit. In addition, in a case where the operation mode is the non-binding mode, the controlling step causes the transfer unit to perform the sheet transferring before all the sheets included in the one group are stored in the first storage unit.

In still yet another embodiment, the sheet process device of the present invention comprises a transfer unit for performing sheet transferring from a first storage unit to a second storage unit, the first storage unit capable of storing plural sheets from an upstream side, and controlling means for causing the transfer unit to perform the sheet transferring when the number of sheets stored in the first storage unit reaches a reference value. In addition, the reference value in a case where the sheets in a group composed of the plural sheets of a first size are stored in the first storage unit is smaller than the reference value in a case where the sheets in a group composed of the sheets of a second size smaller than the first size are stored in the first storage unit.

In still yet another embodiment, the sheet processing method of the present invention provides a control method for a sheet process device which comprises a transfer unit for performing sheet transferring from a first storage unit to a second storage unit, the first storage unit capable of storing plural sheets from an upstream side. More specifically, the method comprises a controlling step of causing the transfer unit to perform the sheet transferring when the number of sheets stored in the first storage unit reaches a reference value. In addition, the reference value in a case where the sheets in a group composed of the plural sheets of a first size are stored in the first storage unit is smaller than the reference value in a case where the sheets in a group composed of the sheets of a second size smaller than the first size are stored in the first storage unit.

In still yet another embodiment, the sheet process device of the present invention comprises aligning means for aligning sheets from an upstream side at any one of plural aligning positions including a first aligning position and a second aligning position on a first storage unit, and controlling means for causing, in case of aligning the sheets of a first group at the first aligning position on the first storage unit, the aligning means to align the sheets of a second group subsequent to the first group at the second aligning position. In addition, the controlling means operates the aligning means such that the distance between the first aligning position at which the sheets of the first group are aligned and the second aligning position at which the sheets of the second group are aligned in a binding mode to perform a binding process to the sheets is made different from the distance between the first aligning position at which the sheets of the first group are aligned and the second aligning position at which the sheets of the second group are aligned in a non-binding mode not to perform the binding process.

In still yet another embodiment, the sheet processing method of the present invention provides a control method for a sheet process device which comprises aligning means for aligning sheets from an upstream side at any one of plural aligning positions including a first aligning position and a second aligning position on a first storage unit. More specifically, the method comprises a controlling step of causing, in case of aligning the sheets of a first group of the first aligning position on the first storage unit, the aligning means to align the sheets of a second group subsequent to the first group at the second aligning position. In addition, the controlling step operates the aligning means such that the distance between the first aligning position at which the sheets of the first group are aligned and the second aligning position at which the sheets of the second group are aligned in a binding mode to perform a binding process to the sheets is made different from the distance between the first aligning position at which the sheets of the first group are aligned and the second aligning position at which the sheets of the second group are aligned in a non-binding mode not to perform the binding process.

Other objects and features of the present invention will become apparent from the following detailed description and the accompanying drawings.

DETAILED DESCRIPTION OF PREFERRED EMBODIMENT

The embodiment of a sheet process device according to the present invention will be explained hereinafter. The sheet process device in the embodiment is installed to an image formation apparatus, and processes or handles sheets discharged from the image formation apparatus.

Figure 1:
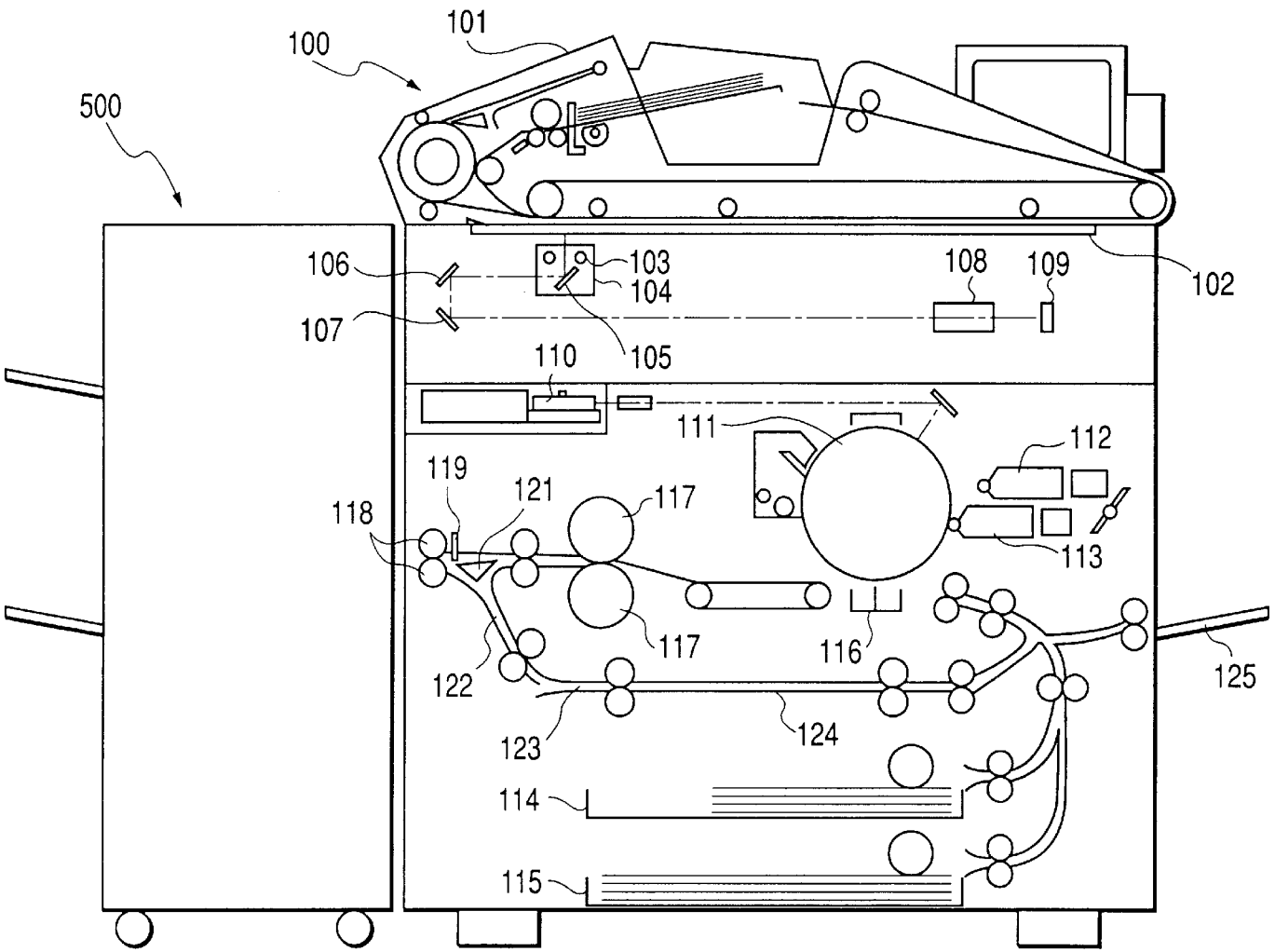
FIG. 1 is a sectional view showing structures of an image formation apparatus and a sheet process device according to an embodiment of the present invention.

Initially, a body of the image formation apparatus will be explained. FIG. 1 is a sectional view showing structures of the image formation apparatus and the sheet process device according to the embodiment.

As shown in FIG. 1, an image formation apparatus 100 mounts thereon an automatic original feed unit 101. The unit 101 feeds a setting original leftward from its initial page one by one in due order, carries the fed original from left to right above a previously set running read position on a platen glass 102 through a curved path, and then carries the original outward. At a time when the original carried from left to right passes through the running read position on the glass 102, an image on this original is read by a scanner unit 104 supported at a position corresponding to the running read position. Concretely, when the original passes through the running read position, a face of the original to be read (referred as read face hereinafter) is illuminated by light from a lamp 103 of the scanner unit 104, and reflected light from the read face of the original is guided to a lens 108 through mirrors 105, 106 and 107. The light passed through the lens 108 is color separated by an RGB color separation filter and then visualized as an image on an image pickup face of an image sensor unit 109.

By carrying the original from left to right such that it passes through the running read position, an original reading scan is performed. In this scan, it should be noted that a direction perpendicular to an original carrying direction is considered as a mainscan direction and the original carrying direction itself is considered as a sub-scan direction. That is, at the time when the original passes through the running read position, the original image is read line by line in the main-scan direction by the image sensor unit 109, and simultaneously the original is carried in the sub-scan direction, so that the whole original image is read. Further, the optically read image is converted into image data and outputted by the image sensor unit 109. The image data outputted from the unit 109 is subjected to a predetermined process, and then the obtained data is inputted to an exposure control unit 110 as a video signal.

In a case where the original image is read without using the automatic original feed unit 101, the scanner unit 104 is moved from left to right to scan the original in a state that the original mounted on the platen glass is at rest, thereby reading the original image (original fixation read).

The exposure control unit 110 modulates and outputs laser beam on the basis of the inputted video signal, and the laser beam is irradiated onto a photosensitive drum 111 in a scanning manner. Thus, an electrostatic latent image according to the laser beam is formed on the drum 111. In this case, the unit 110 outputs the laser beam such that a correct image (i.e., not mirror image) is formed in case of the original fixation read.

The electrostatic latent image on the photosensitive drum 111 is visualized as a development-agent image by means of development agents respectively supplied from development units 112 and 113. Further, the sheet is fed from a cassette 114, a cassette 115 or a manual paper feed unit 125 at timing synchronous with start of laser beam irradiation, and the fed sheet is carried between the photosensitive drum 111 and a transfer unit 116. Then, the development-agent image formed on the drum 111 is transferred onto the fed sheet by the transfer unit 116.

The sheet onto which the development-agent image has been transferred is carried to a fixing unit 117, and the unit 117 fixes the development-agent image to the sheet by heat pressing. The sheet passed through the unit 117 is discharged outward by discharge rollers 118. In a case where double-face recording has been set, it is controlled that the sheet is guided to reverse paths 122 and 123 by a switching operation of a flapper 121, carried to a paper refeed carry path 124, and then again fed between the photosensitive drum 111 and the transfer unit 116 at the above timing. Further, in a case where a face of the sheet on which the image is formed (referred as image-formed face hereinafter) is reversed and discharged, it is controlled that the sheet is once guided into the reverse paths 122 and 123 by the switching operation of the flapper 121, carried toward the discharge rollers 118 by the switching operation of the flapper 121, and then discharged outward through the rollers 118. Hereinafter, such the control is called as a reverse paper discharge control. By the reverse paper discharge control, the sheet can be discharged in such a state as its image-formed face is turned downward.

As shown in the drawing, in a case where a later-described sheet process device (referred as finisher hereinafter) 500 is installed to the image formation apparatus 100, the apparatus is set to perform such the reverse paper discharge control.

Figure 3:
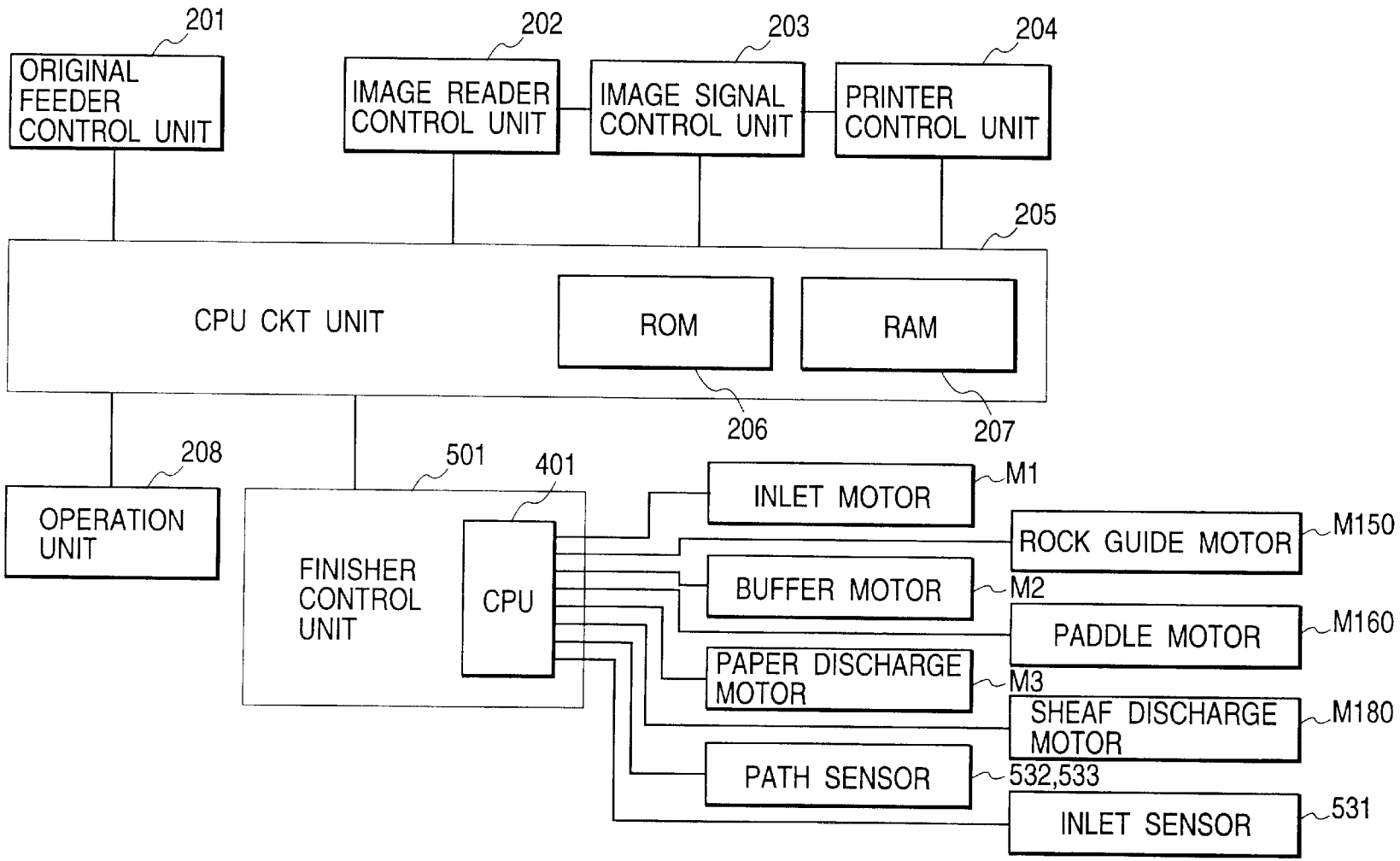
FIG. 3 is a block diagram showing a structure of a controller in the image formation apparatus shown in FIG. 1.

Subsequently, a structure of a controller to control the entire apparatus will be explained with reference to FIG. 3. FIG. 3 is the block diagram showing the structure of the controller in the image formation apparatus shown in FIG. 1.

As shown in FIG. 3, the controller has a CPU circuit unit 205 which contains therein a CPU (not shown), a ROM 206 and a RAM 207. Thus, the controller entirely controls an original feeder control unit 201, an image reader control unit 202, an image signal control unit 203, a printer control unit 204, an operation unit 208 and a finisher control unit 501, on the basis of control programs stored in the ROM 206. The RAM 207 temporarily stores control data, and is used as a working area for a calculation process in the control.

The original feeder control unit 201 drives and controls the automatic original feed unit 101 on the basis of an instruction from the CPU circuit unit 205. The image reader control unit 202 drives and controls the above scanner unit 104, the image sensor unit 109 and the like, to transfer RGB analog image signals outputted from the unit 109 to the image signal control unit 203.

The image signal control unit 203 converts each of the RGB analog image signals transferred from the unit 109 into a digital signal, performs a necessary process on the obtained digital signal, converts the processed digital signal into the video signal, and finally outputs the obtained video signal to the printer control unit 204. Such the process operation by the unit 203 is controlled by the CPU circuit unit 205. The printer control unit 204 drives the above exposure control unit 110 on the basis of the inputted video signal.

The operation unit 208 has plural keys for setting various functions concerning the image formation, a display unit for displaying information representing setting states, and the like. Thus, the unit 208 outputs a key signal corresponding to each key operation to the CPU circuit unit 205, and also displays the corresponding information on the basis of a signal from the unit 205.

The finisher control unit 501 which is installed in the finisher 500 drives and controls the finisher 500 as a whole by sending/receiving information to/from the CPU circuit unit 205 through a not-shown communication IC (IPC). The finisher control unit 501 has a CPU 401. Various actuators such as an inlet motor M1, a buffer motor M2, a paper discharge motor M3 and the like, and various sensors such as an inlet sensor 531, a path sensor 532 and the like are connected to the CPU 401.

Figure 4:
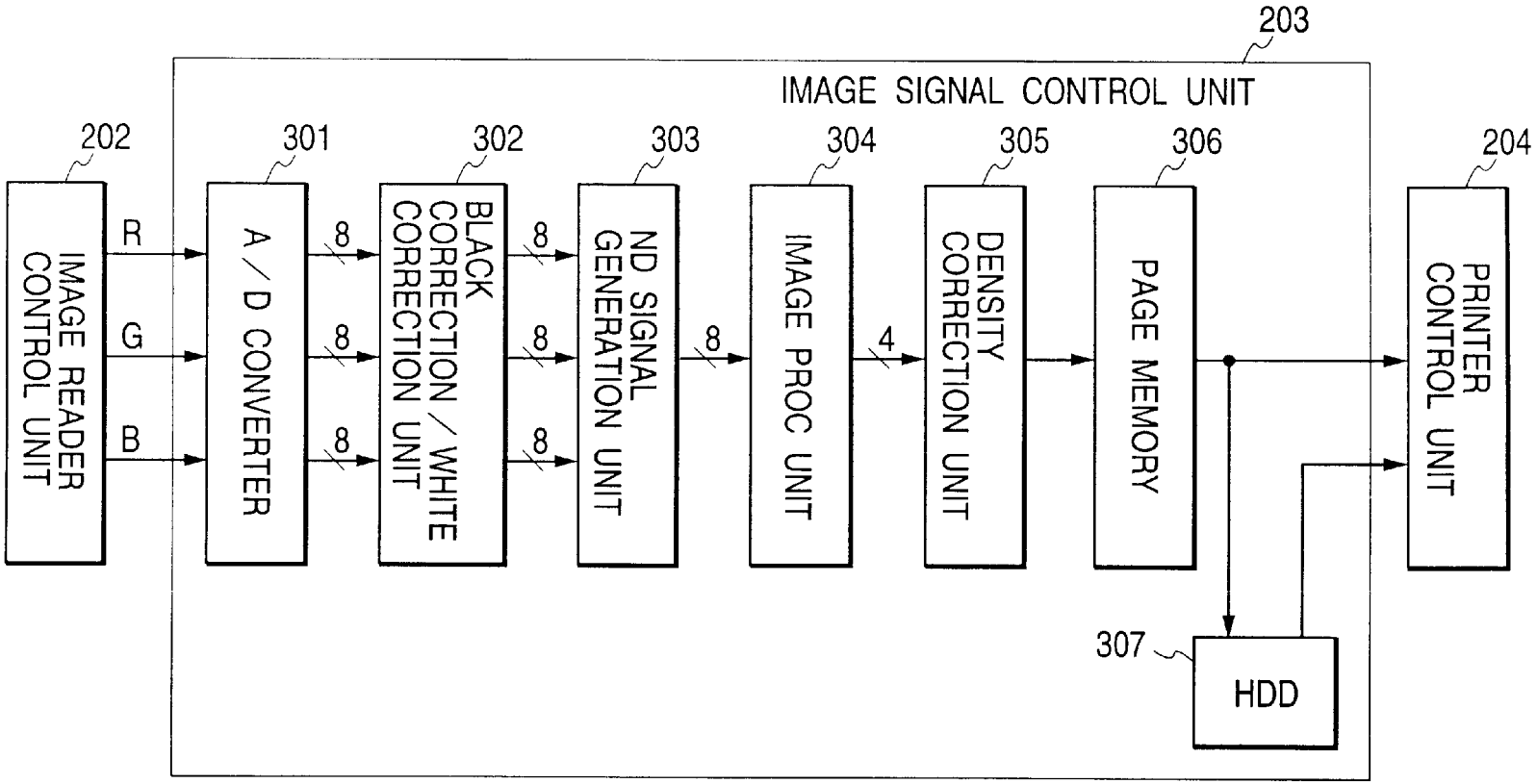
FIG. 4 is a block diagram showing a structure of an image signal control unit 203 shown in FIG. 3.

Subsequently, a structure of the image signal control unit 203 will be explained with reference to FIG. 4. FIG. 4 is the block diagram showing the structure of the image signal control unit 203 shown in FIG. 3.

As shown in FIG. 4, the image signal control unit 203 has an A/D converter 301 which converts the RGB analog image signals sent from the image reader control unit 202 into the RGB digital signals and outputs the obtained digital signals. The RGB digital signals are inputted to a black correction/white correction unit 302, and the unit 302 performs shading correction on the inputted RGB digital signals. The shading-corrected RGB digital signals are then inputted to an ND signal generation unit 303, and the unit 303 generates a luminance signal from these RGB digital signals. The generated luminance signal is then inputted to an image process unit 304. The unit 304 performs various image processes such as a zooming process (i.e., reduction and enlargement process) on the inputted luminance signal, and the processed luminance signal is then inputted to a density correction unit 305. The unit 305 performs luminance-density conversion on the inputted luminance signal, and further performs density correction at a printer. Then, the obtained signal is stored in a page memory 306 as the video data (or video signal).

The page memory 306 has a storage capacity corresponding to one page of the predetermined-size original. The video data is stored in the memory 306 in the image reading order of the above original image reading scan. At the time of original fixation read, the stored video data is read in the storing order. On the other hand, at the time of original running read, the stored video data is read in the reverse order as to the main-scan direction and in the storing order as to the sub-scan direction. That is, at the time of original running read, the image read in one direction along the main-scan direction is reversed toward a direction opposite to such one direction along the main-scan direction, whereby a mirror image process is performed.

It should be noted that the mirror image process can be achieved even in a manner that the main-scan direction is reversed at the time of storing the video data in the page memory 306, and then the stored video data is read always in the determined direction.

The video data read from the page memory 306 is once stored in a hard disk drive (HDD) 307 if necessary, and the video data read from the HDD 307 is sent to the printer control unit 204 as the video signal. For example, in case of performing copy output for plural pages, the video data of the first page is directly outputted from the memory 306 to the unit 204, but the video data of the second and following pages are once stored in the HDD 307 and then sent to the unit 204.

Subsequently, an original setting state that the original is being set in the automatic original feed unit 101 and a paper discharge state that the sheet on which the original image has been formed is controlled to be inverted and then discharged will be explained with reference to FIGS. 5A to 5D. FIGS. 5A to 5D are the views showing relation between the original setting state and the paper discharge state.

Figure 5A:
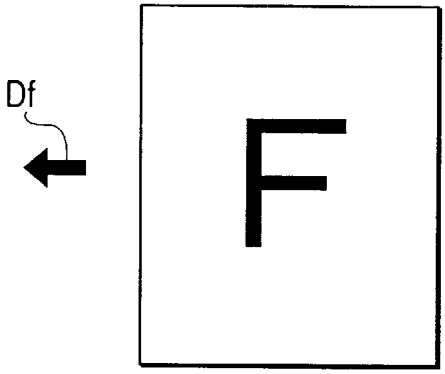
FIGS. 5A, 5B, 5C and 5D are views showing relation between a state that an original is set and a state that a sheet on which an original image has been formed is discharged.

In the embodiment, as shown in FIG. 5A, the original of which read face has been turned upward is set on the automatic original feed unit 101 such that the first page of the original is put on uppermost.

Figure 5B:
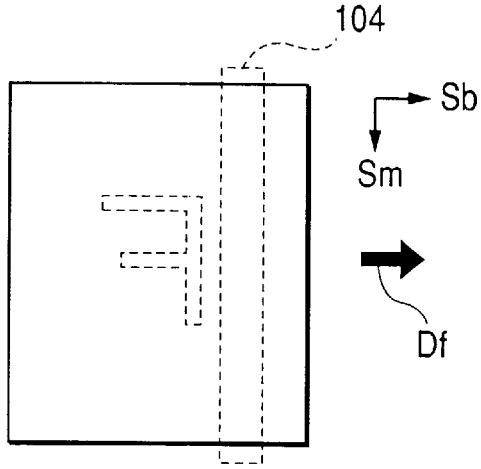
Figure 5C:
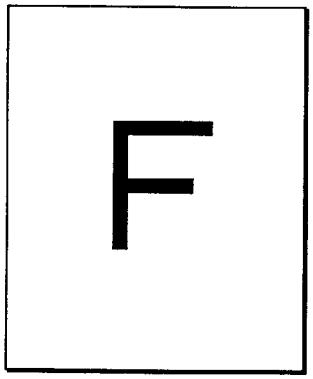
Figure 5D:
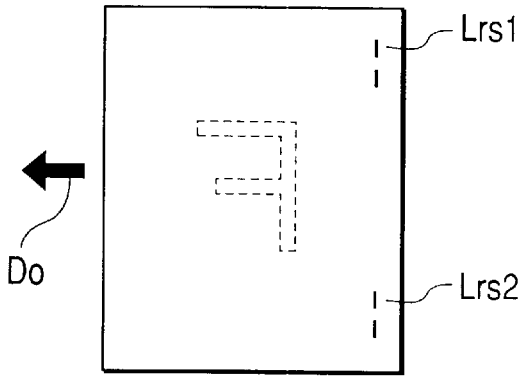

In such the original setting state, the automatic original feed unit 101 feeds and carries the original from its first page (i.e., uppermost page) in due order, to the platen glass 102. On the glass 102, as shown in FIG. 5B, the original of which read face is opposite to an upper face of the glass 102 is carried in a Df direction. At the time when the original passes through the running read position, the image on the read face of the original is read in a main-scan direction Sm by the scanner unit 104 supported at the running read position. Thus, as the image on the read face of the original is read in the main-scan direction Sm, the original is carried in the Df direction (i.e., sub-scan direction Sb), whereby the original reading scan is performed for the entire read face. If the running-read image is formed as it is, this image becomes a mirror image. Therefore, to prevent this, the read image is subjected to the above mirror image process and then formed on the sheet in such an image formation process as above. As a result, as shown in FIG. 5C, the image facing toward the same direction as that at the time of the original setting state is formed on the image formation face (i.e., upper face) of the sheet, and the sheet passes through the fixing unit 117. This sheet is subjected to the above reverse paper discharge control, and the sheet of which image formation face has been turned downward is then discharged in a Do direction as shown in FIG. 5D.

Figure 2:
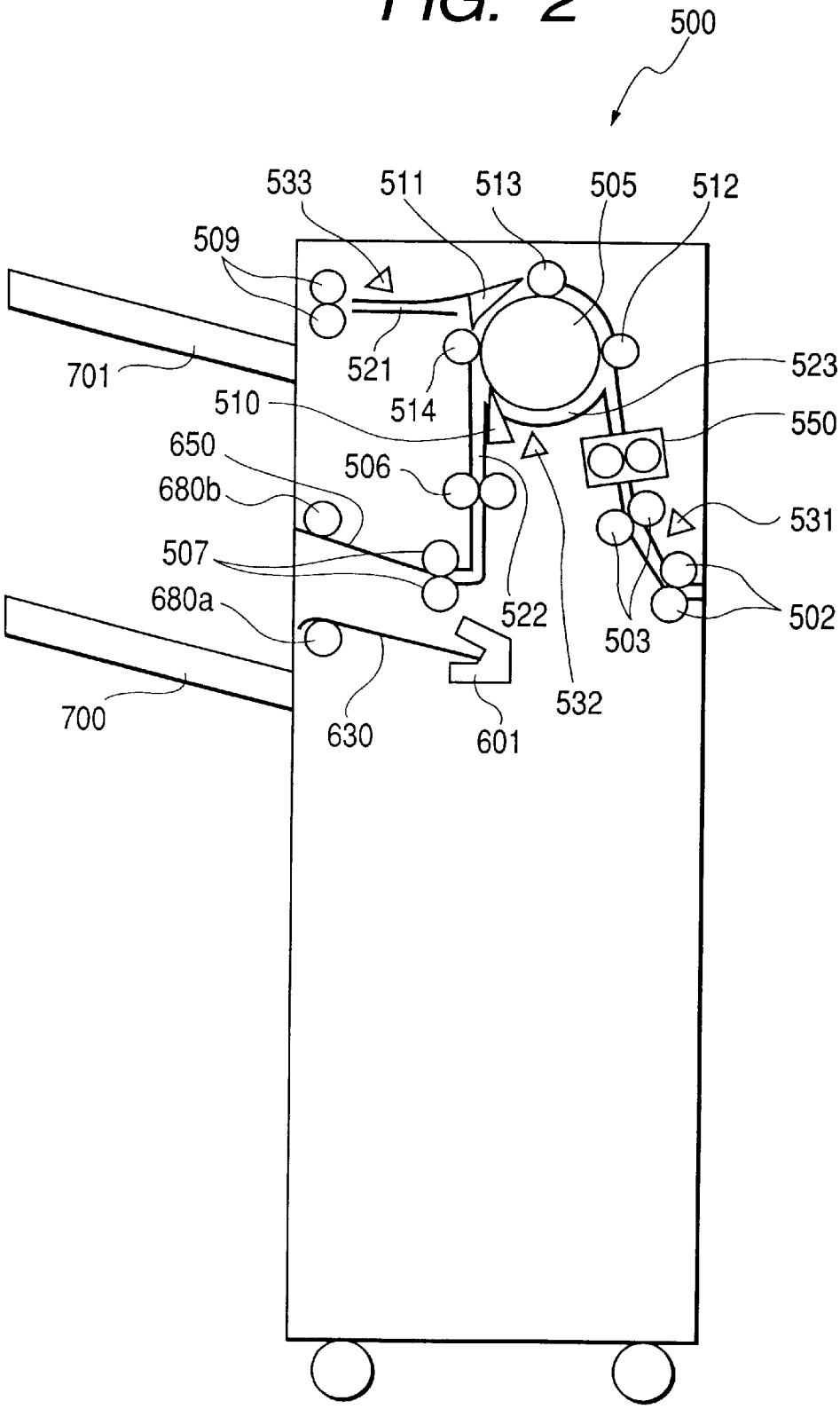
FIG. 2 is a sectional view showing a structure of a finisher 500 shown in FIG. 1.

Subsequently, a structure of the finisher 500 will be explained with reference to FIG. 2. FIG. 2 is the sectional view showing the structure of the finisher 500 shown in FIG. 1.

The finisher 500 performs various sheet postprocesses such as a process to sequentially take in the plural sheets discharged from the image formation apparatus 100, adjust or align the took-in sheets and sheaf the adjusted sheets, a staple process to bind or staple a trailing edge of an obtained sheaf by a stapler, a punch process to punch holes in the trailing edge side of the sheaf, a sort process, a nonsort process and the like. When the finisher 500 is connected to the apparatus 100 and the original running read is performed, the image corrected through the mirror process is formed on the sheet in the apparatus 100, and the sheet of which image formation face has been turned downward in the reverse paper discharge control is then discharged from the apparatus 100. Subsequently, in the finisher 500, the above various processes such as the staple process and the like are performed on the above discharged sheet.

As shown in FIG. 2, the finisher 500 takes in the sheet discharged from the image formation apparatus 100 by a pair of inlet rollers 502, and the took-in sheet is then carried toward a buffer roller 505 by a pair of carrier rollers 503. An inlet sensor 531 is provided at the halfway position on the carrier path between the rollers 502 and the rollers 503, and a punch unit 550 is provided at the halfway position on the carrier path between the rollers 503 and the roller 505. If necessary, the punch unit 550 operates to punch the holes in the trailing edge side of the carried sheet.

The buffer roller 505 can layer and wind thereon a predetermined number of sheets carried by the rollers 503. That is, while the roller 505 is rotating, the sheet is wound around an outer periphery of the roller 505 by pressure rollers 512, 513 and 514, and the wound sheet is then carried in a rotational direction of the roller 505.

A switch flapper 511 is provided between the pressure rollers 513 and 514, and a switch flapper 510 is provided at a downstream side of the roller 514. The flapper 511 separates the wound sheet from the buffer roller 505 and guides the separated sheet to a nonsort path 521 or a sort path 522. The flapper 510 separates the wound sheet from the roller 505 and guides the separated sheet to the sort path 522, or guides the sheet wound around the roller 505 to a buffer path 523 as it is.

When the sheet wound around the roller 505 is guided to the nonsort path 521, the wound sheet is separated from the roller 505 and guided to the path 521 by the switch flapper 511. The sheet guided to the path 521 is then discharged onto a sample tray 701 through a pair of discharge rollers 509. A paper discharge sensor 533 is provided at the halfway position on the nonsort path 521.

When the sheet wound around the buffer roller 505 is guided to the buffer path 523, both the switch flappers 510 and 511 do not operate. Thus, the sheet is carried to the path 523 in the state that the sheet is being wound around the roller 505. A buffer path sensor 532 is provided at the halfway position on the path 523 to detect the sheet thereon.

When the sheet wound around the buffer roller 505 is guided to the sort path 522, the switch flapper 511 does not operate but only the switch flapper 510 operates to separate the wound sheet from the roller 505. The plural sheets separated are then guided to the sort path 522 and stacked or put on an intermediate tray (referred as process tray hereinafter) 630 through pairs of carrier rollers 506 and 507. The sheets stacked on the process tray 630 in the form of sheaf are subjected to an adjustment process, a staple process and the like, if necessary. Then, the processed sheets are discharged onto a stack tray 700 by discharge rollers 680*a* and 680*b*. The roller 680*b* is supported by a rock guide 650, and the guide 650 rocks (or swings) the roller 680*b* by a rock motor (not shown) such that the roller 680*b* comes into contact with the uppermost sheet on the tray 630. In the state that the roller 680*b* contacts with the uppermost sheet on the tray 630, the roller 680*b* can cooperate with the roller 680*a* to discharge the sheaf of sheets on the tray 630 toward the stack tray 700.

The above staple process is performed by a stapler 601. The stapler 601 is arranged to be movable along one edge (outer edge) of the process tray 630, and can bind or staple the sheaf of sheets stacked on the tray 630 at its endmost position (i.e., trailing edge) (see FIGS. 21 to 23) of the sheet in a paper carrying direction (leftward direction in FIG. 2).

Figure 18:
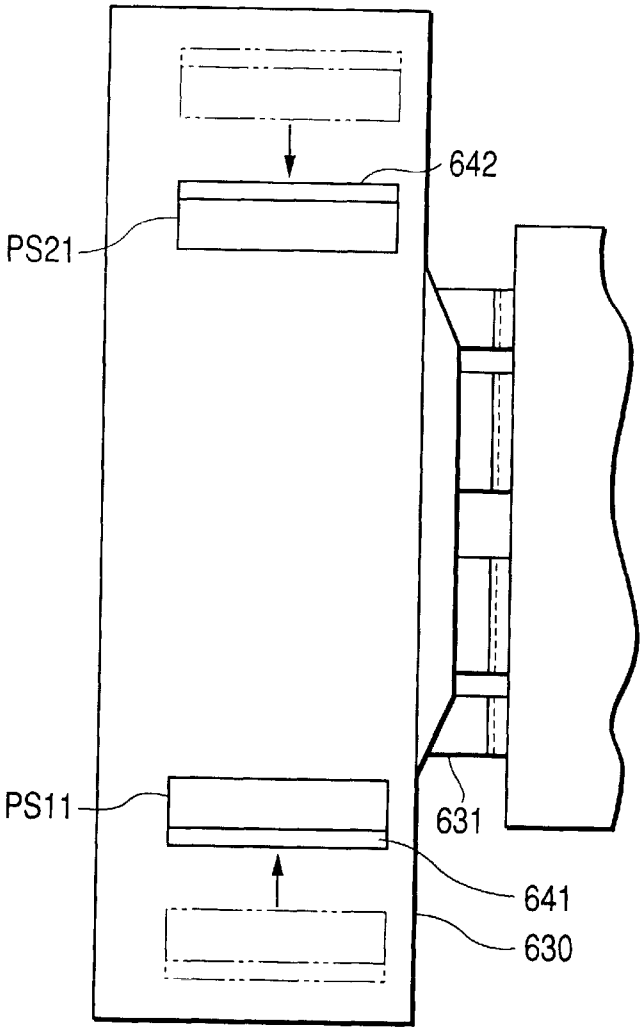
FIG. 18 is a view showing an adjustment operation.
Figure 20:
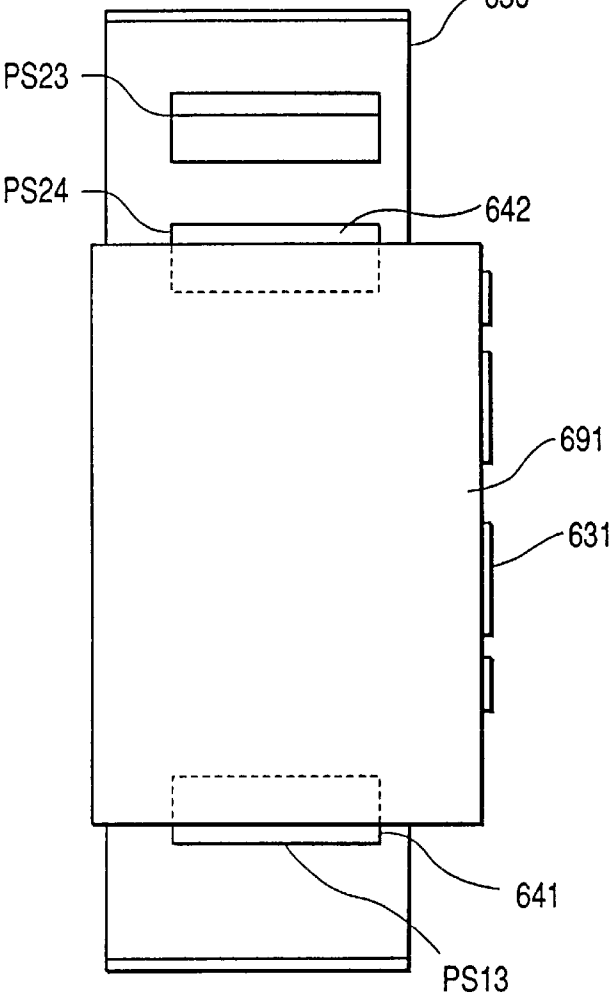
FIG. 20 is a view showing the adjustment operation.
Figure 19:
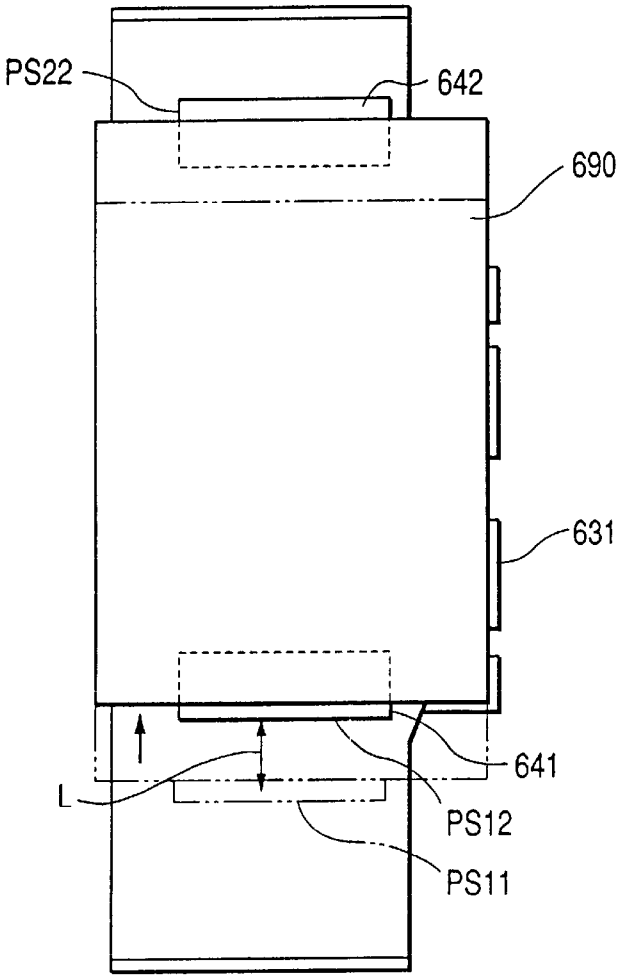
FIG. 19 is a view showing the adjustment operation.

Subsequently, an adjustment (or alignment) operation in the finisher 500 will be explained with reference to FIGS. 18 to 20. FIGS. 18 to 20 are the views showing the adjustment operation to be performed on the process tray 630 of the finisher 500 shown in FIG. 2.

As shown in FIG. 18, when the initial sheet is discharged from the image formation apparatus 100 onto the process tray 630, front-side and rear-side adjustment members 641 and 642 being on standby at home positions (indicated by alternate long and two short dashed lines) are previously moved to respective positions PS11 and PS21 slightly away from a width of the sheet to be discharged (i.e., distance between PS11 and PS21 is slightly wider than sheet width). As shown in FIG. 19, the sheet discharged on the tray 630 is dropped between the members 641 and 642 as its trailing edge is being supported by a stopper 631, and then the member 641 is moved to a position PS12 at the timing when the downward face of the discharged sheet comes into contact with a support face of the tray 630. By such movement of the member 641, the sheet is moved to a first adjustment position 690 and adjusted.

After adjusting the first sheet, as shown in FIG. 19, the front-side adjustment member 641 is returned to the position PS11 and is on standby for the next sheet to be discharged onto the tray 630. When the next sheet is discharged onto the tray 630, the member 641 is again moved to the position PS12 to adjust the next sheet at the first adjustment position 690. During this operation, the rear-side adjustment member 642 is maintained to be at a position PS22 to act as an adjustment standard.

The above operation is repeated until the final sheet in the sheaf is processed. When the discharge and adjustment of the first sheaf of sheets completes, later-described sheaf discharge is performed to move the sheaf to the stack tray 700.

After the first sheaf is discharged onto the stack tray 700, as shown in FIGS. 19 and 20, the front-side adjustment member 641 is moved from the position PS12 to a position PS13, and also the rear-side adjustment member 642 is moved from the position PS22 to a position PS23. Subsequently, when the first (initial) sheet in the second sheaf is discharged onto the process tray 630, this sheet is similarly dropped between the members 641 and 642 as its trailing edge is being supported by the stopper 631. Then, the member 642 is moved from the position PS23 to a position PS24 at the timing when the downward face of the discharged sheet comes into contact with the support face. By such movement of the member 642, the sheet is moved to a second adjustment position 691 and adjusted. For the second and subsequent sheets, the member 642 is moved to the position PS23 and on standby for the sheet next discharged onto the tray 630. When the discharge of the next sheet onto the tray 630 completes, the member 642 is again moved to the position PS24 to adjust the sheet at the second adjustment position 691. During this operation, the front-side adjustment member 641 is maintained to be at the position PS13 to act as the adjustment standard. The above operation is repeated until the final sheet in the sheaf is processed. When the discharge and adjustment of the second sheaf completes, the later-described sheaf discharge is performed to move the sheaf to the stack tray 700. As shown in FIG. 19, the first adjustment position 690 is far from, in the rear of the tray 630, the second adjustment position 691 by a predetermined amount (i.e., offset distance L).

Figure 17:
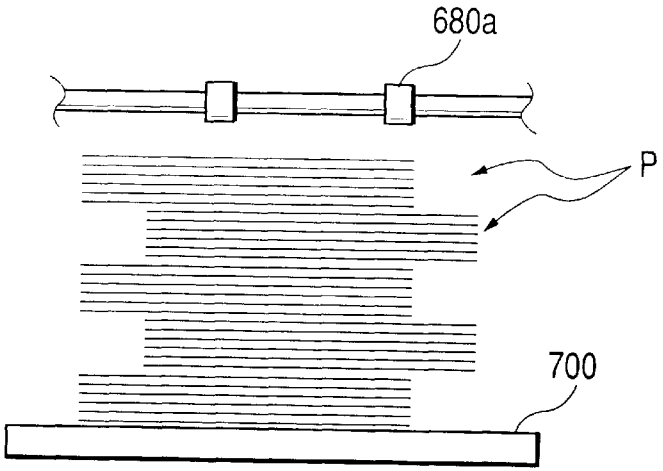
FIG. 17 is a view showing a state that sheaves of sheets are stacked on a stack tray.

After then, the adjustment is performed as the adjustment position of each sheaf is alternately changed or switched between the positions 690 and 691. Thus, as shown in FIG. 17, the plural sheaves of which adjustment positions are alternately changed are stacked on the stack tray 700. That is, by alternately changing the adjustment position for each sheaf, sorting is performed in the offset distance L for the respective sheaves.

The offset distance L is set to be different in each of the sort mode and the staple-sort mode. For example, in the staple-sort mode, the offset distance L is set to have an amount (i.e., distance) L1 sufficient to prevent an overlap of staples (or styli) between the stacked sheaves adjacent to each other. On the other hand, in the sort mode, the offset distance L is set to be a distance L2 sufficient to certainly distinguish the adjacent sheaves from each other. The offset distances L1 and L2 satisfy relation of L1<L2, and process speed in the staple mode can be improved by such setting.

Figure 22:
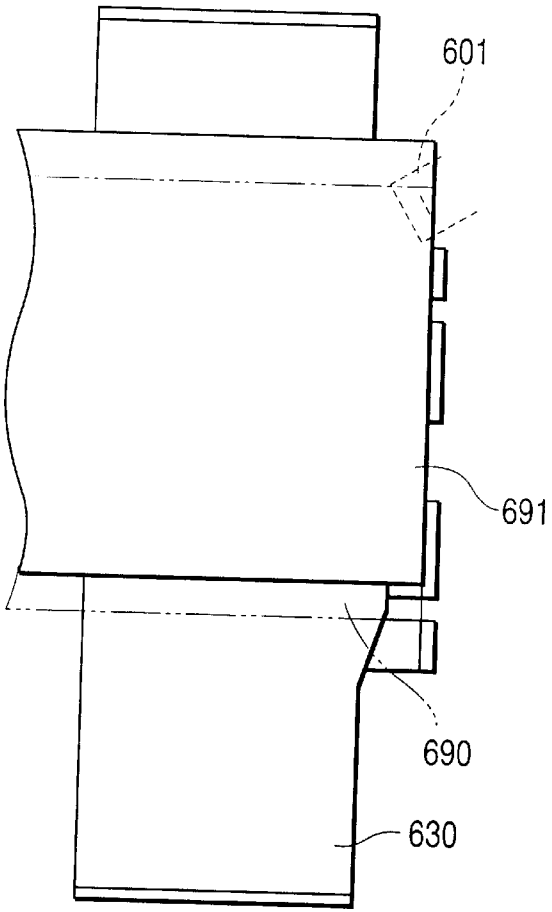
FIG. 22 is a view showing an adjustment position in a front-oblique binding mode.
Figure 21:
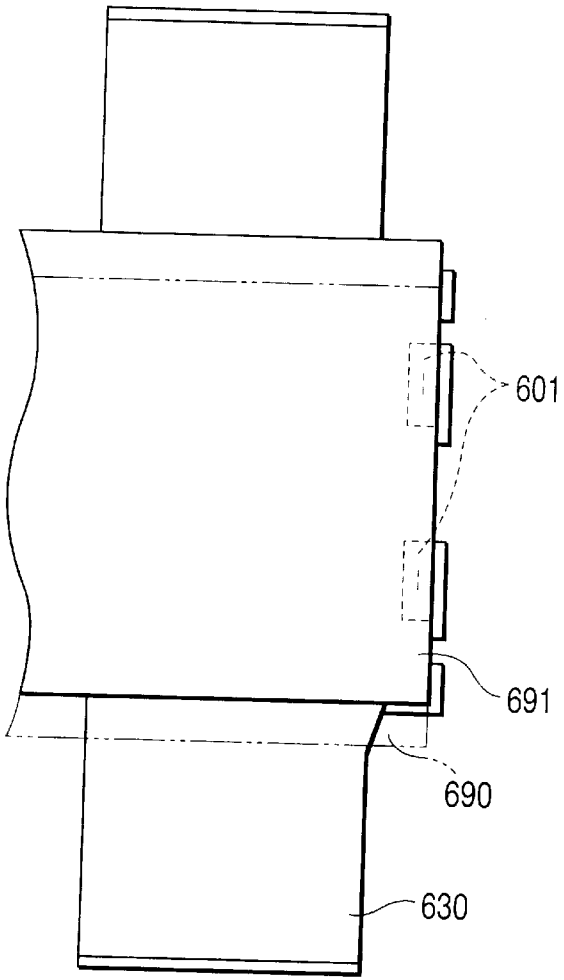
FIG. 21 is a view showing an adjustment position in a two-point binding mode.
Figure 23:
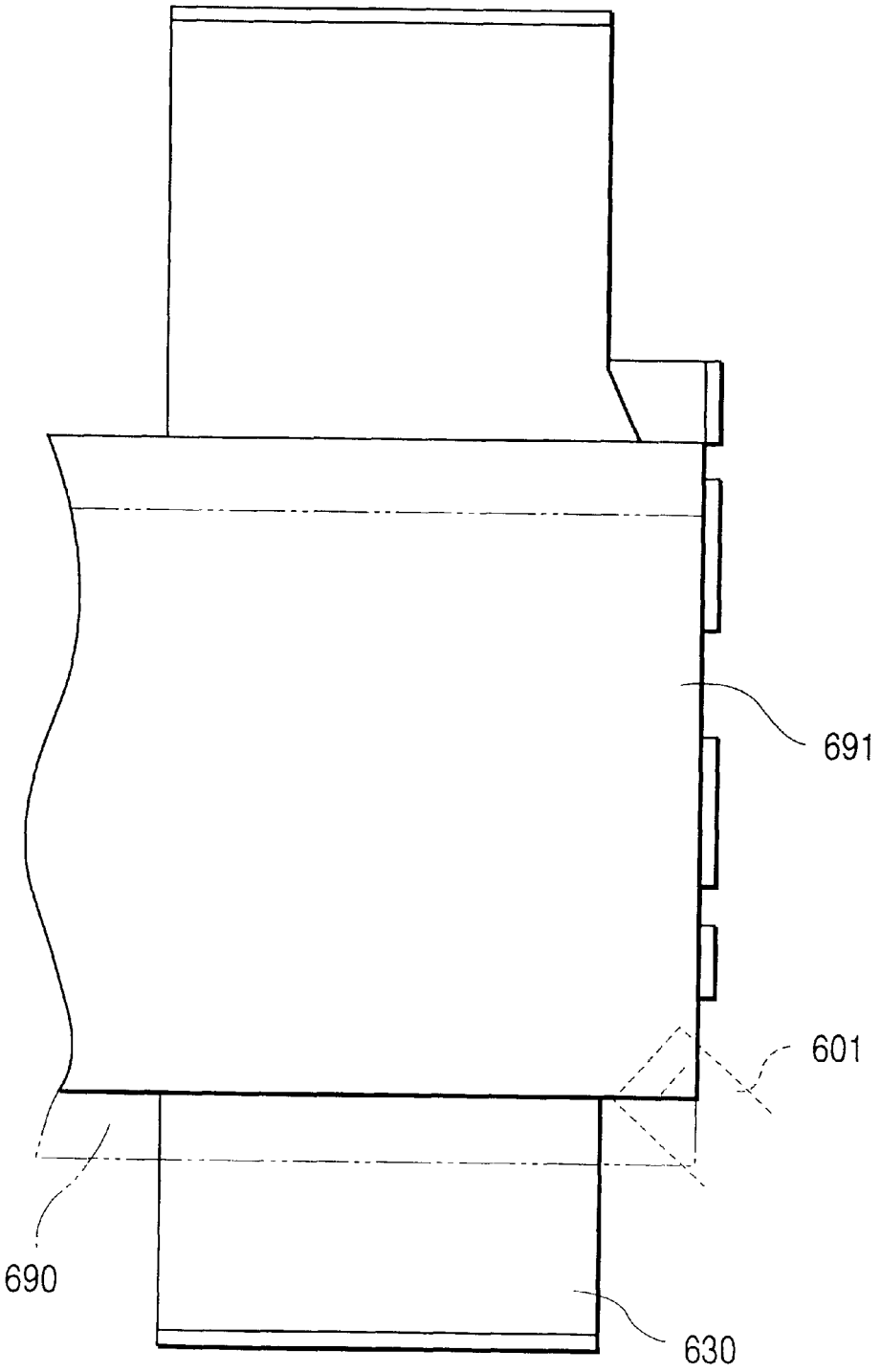
FIG. 23 is a view showing an adjustment position in a rear-oblique binding mode.

Subsequently, the staple operation will be explained with reference to FIGS. 21 to 23. FIGS. 21 to 23 are the views for explaining operation states according to the binding modes (i.e., front-oblique binding mode, rear-oblique binding mode and two-point binding mode) of the stapler 601.

In the staple mode, the stapler 601 is previously on standby at a desired clinch position for the adjusted sheets. Thus, when the discharge and adjustment of the final sheet in the final sheaf completes, the stapler 601 performs the staple operation. In this case, the stapler 601 is controlled to offset-move in synchronism with offset movement (movement amount L1) of the sheaf.

Further, the stapler 601 changes its direction and moves according to the binding modes (i.e., front-oblique binding mode, rear-oblique binding mode and two-point binding mode).

For example, as shown in FIG. 21, in the two-point binding mode, the staple operation to staple the sheaf, at two points on its trailing edge side, adjusted at each of the adjustment positions 690 and 691 is performed. As shown in FIG. 22, in the rear-oblique binding mode, the staple operation to obliquely staple the sheaf, at its trailing-edge rear point, adjusted at each of the adjustment positions 690 and 691 is performed. As shown in FIG. 23, in the front-oblique binding mode, the staple operation to obliquely staple the sheaf, at its trailing-edge front point, adjusted at each of the adjustment positions 690 and 691 is performed. In each of FIGS. 21 to 23, an alternate long and two short dashed line represents the first adjustment position 600, and a solid line represents the second adjustment position 691. At this time, in a case where the adjustment position is in front of the discharge position, the rear-side adjustment member 642 reciprocates to carry the sheet to the front-side adjustment member 641 side being the adjustment standard. On the other hand, in a case where the adjustment position is in the rear of the discharge position, the front-side adjustment member 641 reciprocates to carry the sheet to the rear-side adjustment member 642 side.

Subsequently, the sheaf discharge operation in the staple mode will be explained.

In one-point staple sort mode, when the above adjustment operation terminates, the stapler 601 starts the staple operation. Further, during the adjustment operation or staple operation, the rock guide 650 starts descent. In this case, speed of the rock guide motor is controlled such that the paper discharge roller 680*b* is put on the sheaf about that time when the staple operation terminates.

Descent start timing of the rock guide 650 is variable according to the number of sheets of the sheaf stacked on the process tray 630. That is, if such the number is small, since a movement distance up to putting of the roller 680*b* on the sheaf is long and an operation time of the stapler 601 is short, the rock guide 650 starts descent while the adjustment operation is being performed. On the other hand, if such the number is large, since the movement distance up to putting of the roller 680*b* on the sheaf is short and the operation time of the stapler 601 is long, the rock guide 650 starts descent substantially at the same time when the staple operation starts.

After elapsing a predetermined time from putting of the roller 680*b* on the sheaf to an end of a bound of the roller 680*b*, it is judged whether or not the staple operation terminates. If the operation terminates, the sheaves are discharged onto the stack tray 700 by the rollers 680*a* and 680*b*. On the other hand, if the operation does not terminate, a process waits for termination of the staple operation. In such a state waiting for the termination of the staple operation, sheaf discharge speed control is performed. In this control, the sheaf is carried at high speed after the sheaf carrying starts. However, the discharge speed is reduced before the trailing edge of the sheaf exceeds the trailing edge of the rollers 680*a* and 680*b,* such that the discharge speed becomes suitable for stacking the sheaves onto the stack tray 700 in case of the sheaf discharging.

In the two-point staple sort mode, the rock guide starts decent when the staple operation at a first staple point terminated and thus the stapler moves to a second staple point. While the second point is being stapled, the rock guide 650 is on standby as it is being put on the sheaf. The paper discharge roller 680*b* starts the sheaf discharge operation at the same time when the staple operation terminates. The following operation is identical with that in the one-point staple sort mode.

Subsequently, a flow of the sheet in the finisher 500 will be explained for each of the nonsort mode, the staple-sort mode and the sort mode.

Figure 6:
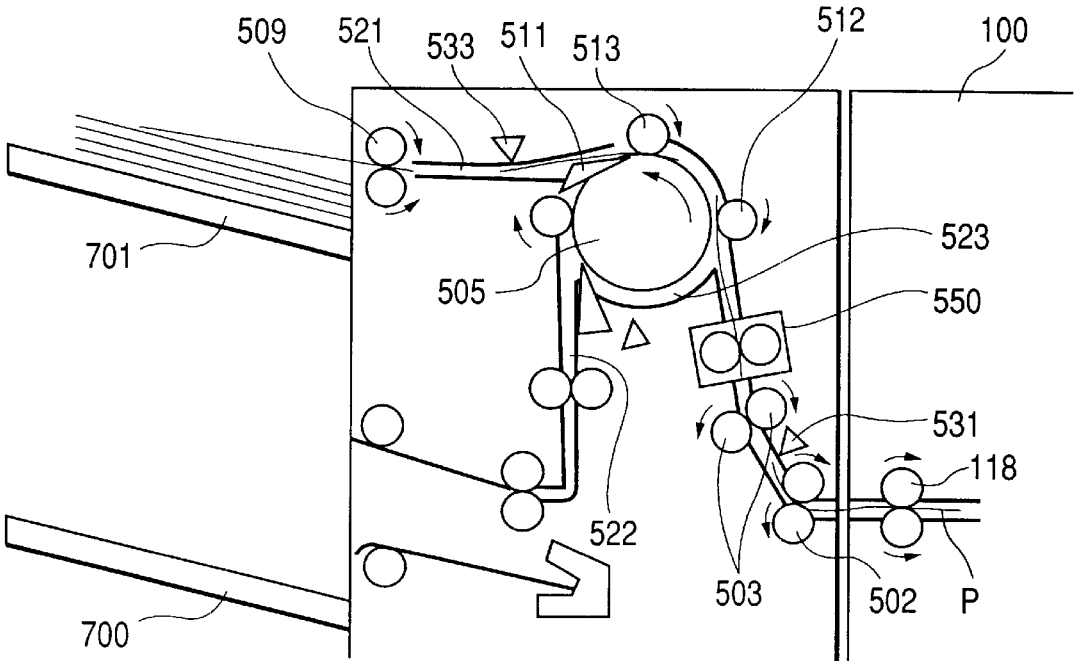
FIG. 6 is a view showing a flow of the sheet in the finisher in a nonsort mode.

Initially, the flow of the sheet in the nonsort mode will be explained with reference to FIG. 6. FIG. 6 is the view showing the flow of the sheet in the finisher 500 in the nonsort mode.

When a user designates, in the image formation apparatus 100, the paper discharge mode as the nonsort mode, as shown in FIG. 6, then the inlet rollers 502, the carrier rollers 503 and the buffer roller 505 are rotatively driven, whereby a sheet P discharged from the apparatus 100 is taken in the finisher 500 and then carried. The switch flapper 511 is rotatively driven by a solenoid (not shown) to a position shown in the drawing, whereby the sheet P is guided into the nonsort path 521. Then, when the paper discharge sensor 533 detects a trailing edge of the sheet P, then the discharge rollers 509 rotate at a speed suitable for the stacking and discharge the sheet P onto the sample tray 701.

Subsequently, the flow of the sheet in the staple-sort mode will be explained with reference to FIGS. 7 to 13, FIGS. 14A and 14B and FIG. 17. FIGS. 7 to 13, FIGS. 14A and 14B are the views showing the flow of the sheet in the staple-sort mode, and FIG. 17 is the view showing a state that the plural sheaves of sheets are stacked on the stack tray 700 in the finisher 500.

Figure 7:
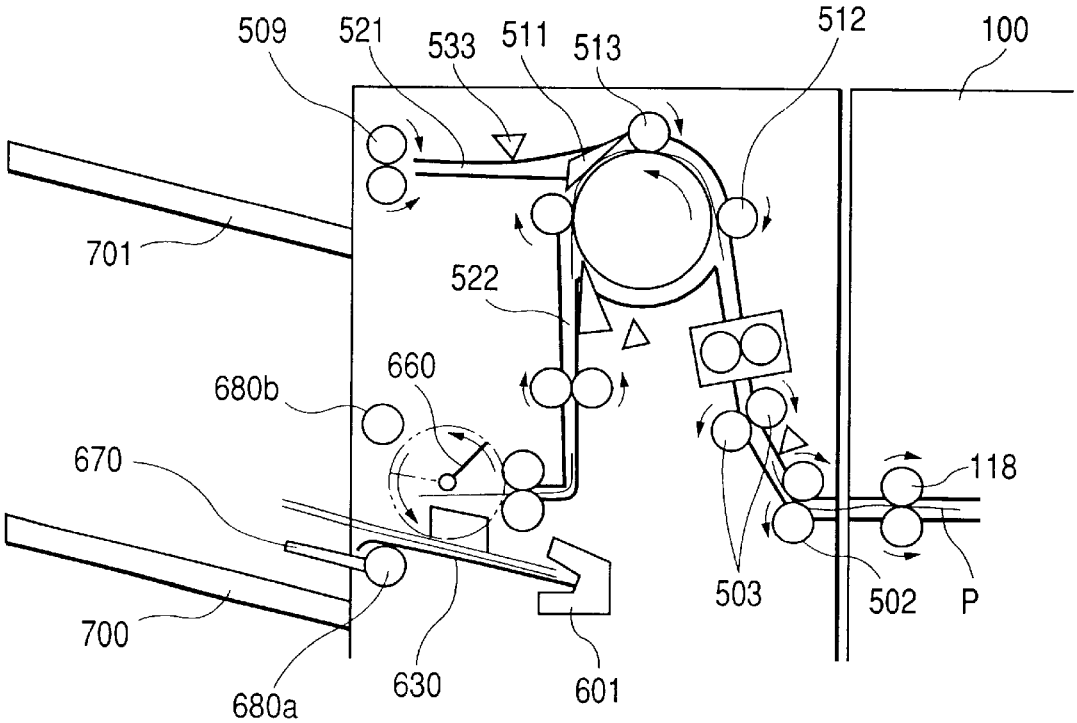
FIG. 7 is a view showing a flow of the sheet in the finisher in a staple-sort mode.

When the staple-sort mode is designated by the user, as shown in FIG. 7, then the inlet rollers 502, the carrier rollers 503 and the buffer roller 505 are rotatively driven, whereby the sheet P discharged from the apparatus 100 is taken in the finisher 500 and then carried. The switch flappers 510 and 511 are stopped at positions shown in the drawing, whereby the sheet P is guided into the sort path 522. Then, the sheet P guided in the path 522 is discharged onto the process tray 630 by the carrier rollers 507. At this time, dangling, insufficient returning or the like of the sheet P discharged by the rollers 507 can be prevented by a projection tray 670 projected upward. Also, alignment of the sheets on the tray 630 can be improved by the tray 670.

The sheet P discharged on the process tray 630 starts moving on the tray 630 toward the stopper 631, by its own weight. Such movement of the sheet P is assisted by an assist member such as a paddle or the like (not shown). When the trailing edge of the sheet P hits against the stopper 631 and thus the sheet P stops, then the discharged sheets are adjusted by the adjustment members 641 and 642 as described above. When the predetermined number of sheets P are adjusted and stacked, then the above staple operation and the sheaf discharge operation are performed, whereby the sheaf of sheets P are discharged onto the stack tray 700. As described above, since the sheet of which image-formed face was turned downward is discharged from the image formation apparatus 100, the first page of which image-formed face was turned downward is at the lowermost position in the sheaf consisting of the predetermined number of adjusted sheets stacked upward in the page order. Further, the sheaf is bound at a position Ls (upper right position Lrs1 or lower right position Lrs2) shown in FIGS. 5A to 5D.

Subsequently, the flow of the sheets constituting the next (i.e., second) sheaf will be explained. This flow occurs while the sheet P of the first sheaf is took in and then the first sheaf is discharged.

Figure 8:
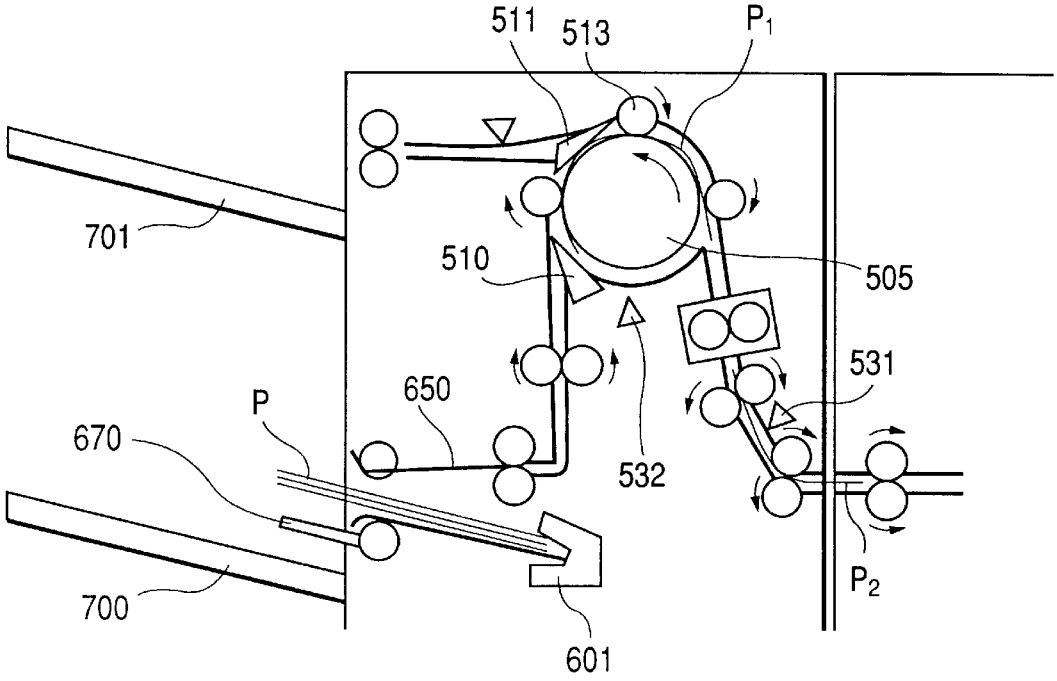
FIG. 8 is a view showing a flow of the sheet in the finisher in the staple-sort mode.
Figure 9:
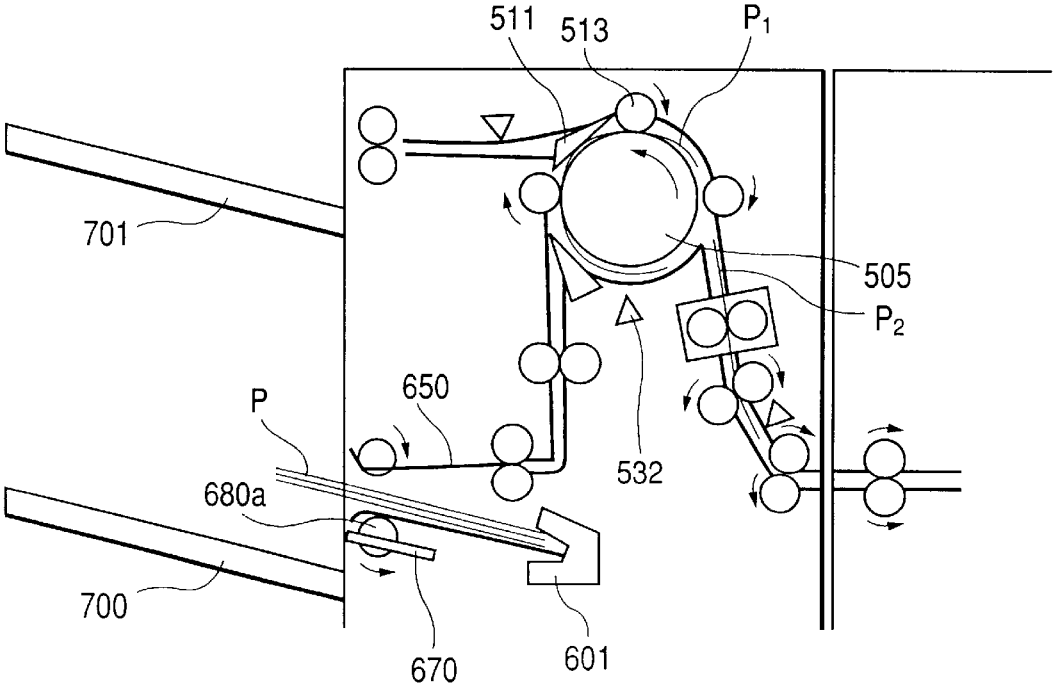
FIG. 9 is a view showing a flow of the sheet in the finisher in the staple-sort mode.
Figure 10:
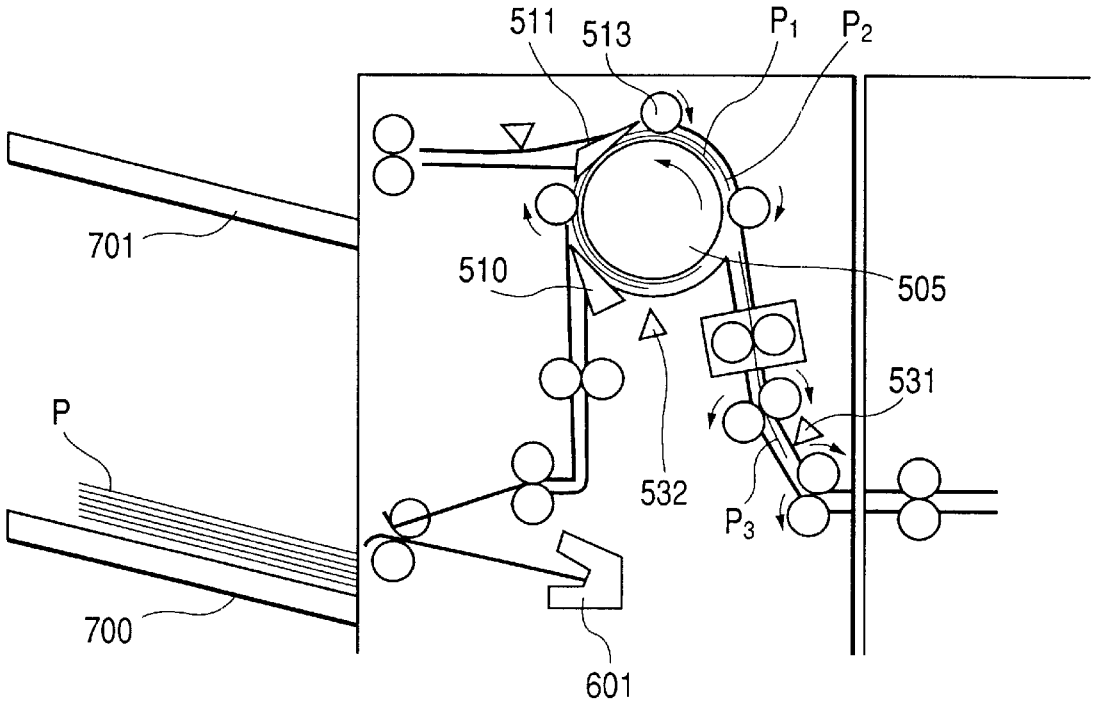
FIG. 10 is a view showing a flow of the sheet in the finisher in the staple-sort mode.
Figure 11:
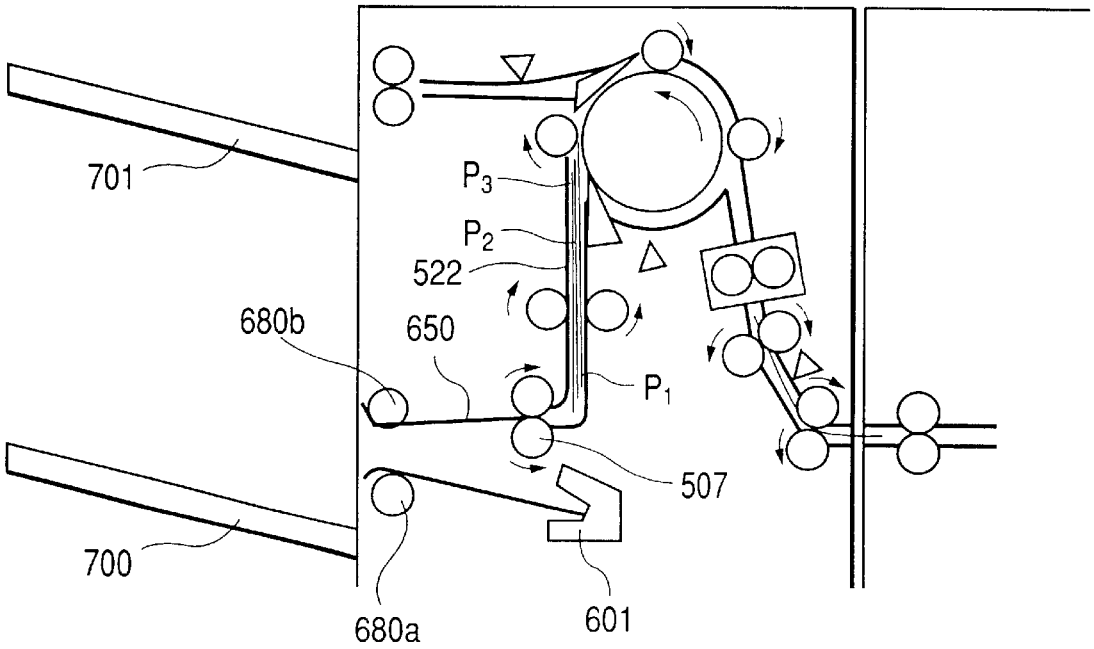
FIG. 11 is a view showing a flow of the sheet in the finisher in the staple-sort mode.
Figure 12:
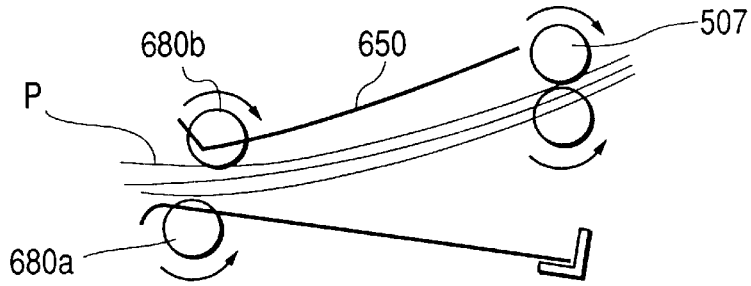
FIG. 12 is a view showing a state that the sheet is discharged onto a process tray.

As shown in FIG. 8, a sheet P1 of the first page in the next (i.e., second) sheaf discharged from the image formation apparatus 100 is wound around the buffer roller 505 by operating the switch flapper 510. The roller 505 carries the sheet P1 to a position far from the buffer path sensor 532 for a predetermined distance and then stops. As shown in FIG. 9, when a leading edge of a sheet P2 of the next page advances from the inlet sensor 531 for a predetermined distance, then the buffer roller 505 starts rotating, whereby the next sheet P2 is overlaid on the sheet P1 such that the sheet P2 is advanced from the sheet P1 by a predetermined distance. As shown in FIG. 10, the sheet P2 is wound around the buffer roller 505 in a state that the sheet P2 is being overlaid on the sheet P1, and then carried to the buffer path sensor 532. After then, the buffer roller 505 again carries the sheet P2 to the position far from the sensor 532 for the predetermined distance and then stops. Further, as shown in FIG. 10, when a leading edge of a sheet P3 of the next page advances from the inlet sensor 531 for the predetermined distance, then the buffer roller 503 again starts rotating. Thus, the sheet P3 is overlaid on the sheaf of the sheets P1 and P2 such that the sheet P3 is advanced from the sheaf for a predetermined distance. The sheets P1, P2 and P3 wound around the roller 505 are separated therefrom by the switch flapper 511 and carried to the sort path 522 as the sheaf P of the three sheets. At this time, the discharge operation of the sheaf P on the process tray 630 has terminated. Thus, as shown in FIG. 12, the rock guide 650 has been descended and its descended position is maintained, whereby the sheaf P of the three sheets is took in between the discharge rollers 680*a* and 680*b*.

Figure 13:
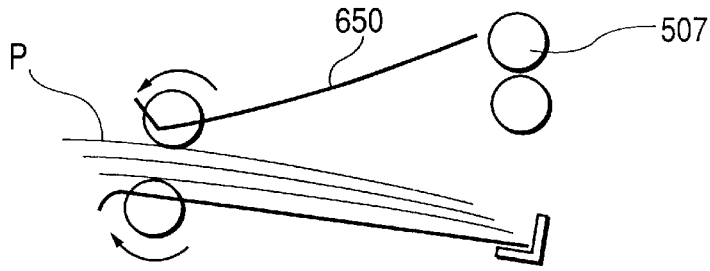
FIG. 13 is a view showing a state that the sheet is discharged onto the process tray.
Figure 14A:
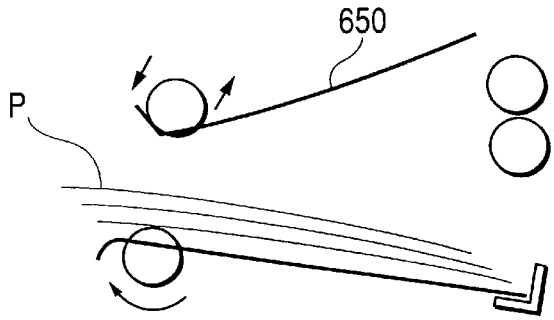
FIGS. 14A and 14B are views showing a state that the sheet is discharged onto the process tray.
Figure 14B:
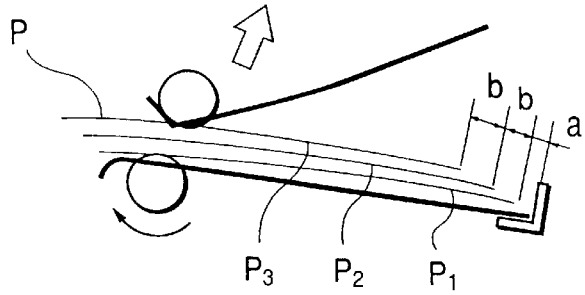

Subsequently, as shown in FIG. 13, when the trailing edge of the sheaf P exceeds the carrier rollers 507 and reaches the process tray 130, then the discharge rollers 680*a* and 680*b* reverse-rotate to carry the sheaf P toward the stopper 631. As shown in FIG. 14A, before the trailing edge of the sheaf P hits against the stopper 631, the rock guide 650 ascends to separate the roller 680*b* from the sheet face. As shown in FIG. 14B, in case of carrying the sheaf P consisting of the plural sheets, each sheet is offset in the carrying direction. That is, the sheet P2 is offset from the sheet P1 toward the side opposite to the stopper 631 side, and also the sheet P3 is similarly offset from the sheet P2. The fourth and subsequent sheets are discharged onto the process tray 630 through the sort path 522 in the same manner as in the discharge operation of the first sheaf. After the second sheaf is stacked on the stack tray 700, the subsequent sheaves are processed by repeating the same operation, whereby the predetermined number of sheaves are stacked on the tray 700. As shown in FIG. 17, the plural sheaves are stacked on the stack tray 700 such that the sheaves are alternately offset. Further, in each sheaf, the first-page sheet of which image-formed face was turned downward is at the lowermost position, and the subsequent sheets are stacked upward in the page order.

Figure 15:
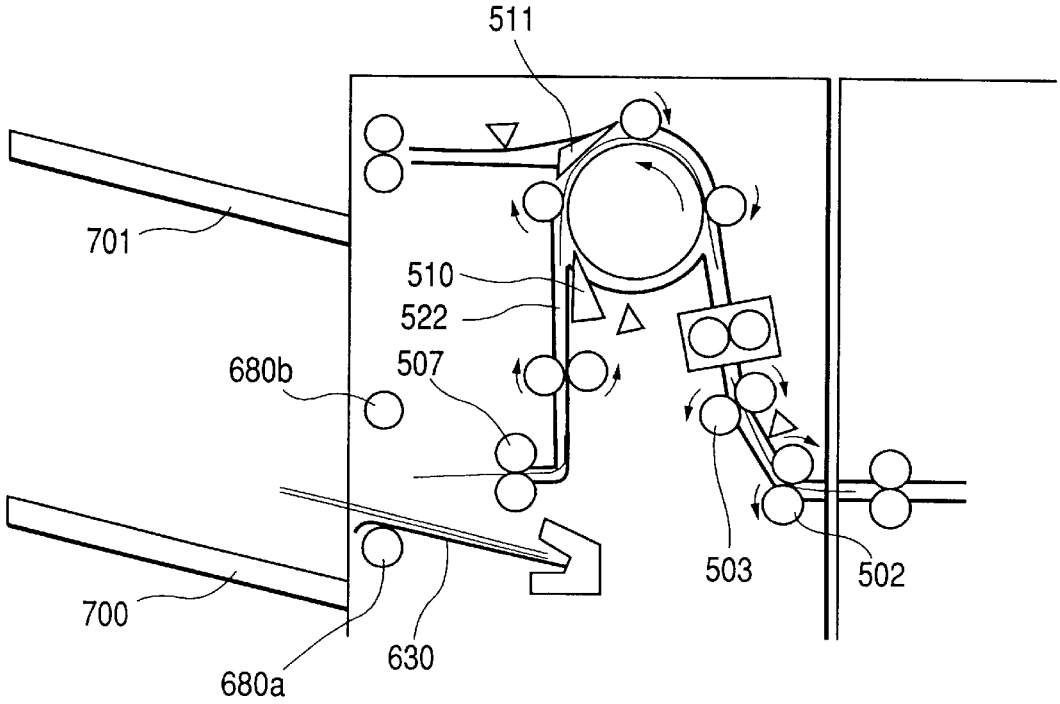
FIG. 15 is a view showing a flow of sheets in the finisher in a sort mode.
Figure 16:
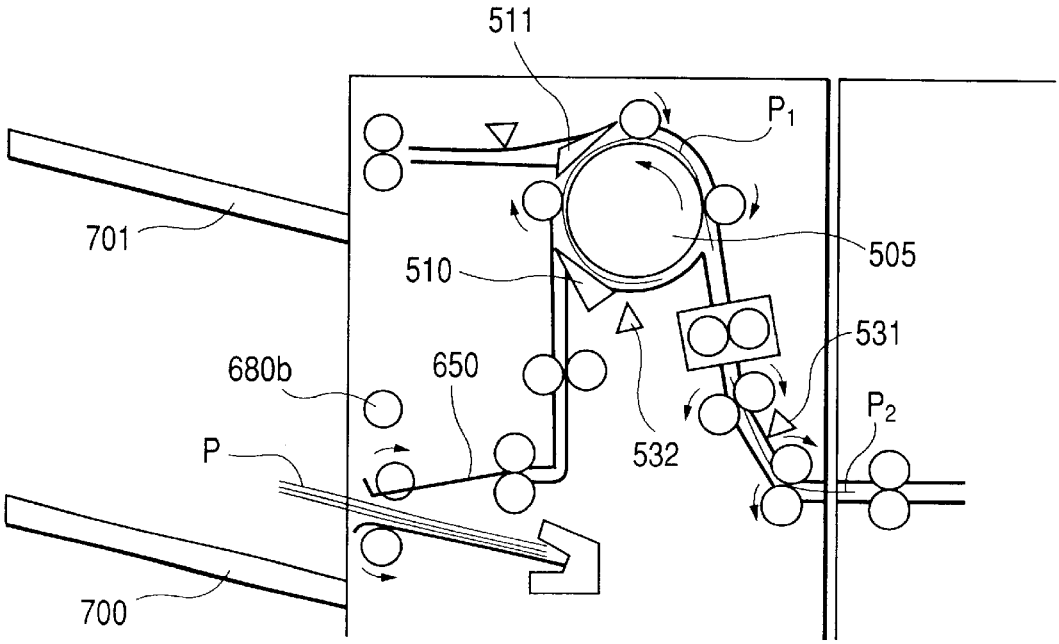
FIG. 16 is a view showing a flow of the sheets in the finisher in the sort mode.

Subsequently, the flow of the sheets in the sort mode will be explained with reference to FIGS. 15 and 16. FIGS. 15 and 16 are the views showing the flow of the sheets in the finisher in the sort mode.

As shown in FIG. 15, when the sort mode is set, then the inlet rollers 502 and the carrier rollers 503 are rotatively driven, whereby the sheets discharged from the image formation apparatus 100 are sequentially stacked on the stack tray 630, in the same manner as in the staple-sort mode. Then, the above sheaf discharge operation is performed to discharge the sheaf P onto the stack tray 700. On the other hand, during this operation, as shown in FIG. 16, the sheet P1 discharged from the apparatus 100 is wound around the buffer roller 505 by operating the switch flapper 510. The roller 505 carries the sheet P1 to the position far from the buffer path sensor 532 for the predetermined distance and then stops. Subsequently, when the leading edge of the next sheet P2 advances from the inlet sensor 531 for the predetermined distance, then the buffer roller 505 starts rotating, whereby the next sheet P2 is overlaid on the sheet P1 such that the sheet P2 is advanced from the sheet P1 by the predetermined distance.

As above, the same operation as in the staple-sort mode is performed in the sort mode, whereby the predetermined number of sheaves are stacked on the tray 700 in the state that the sheaves are alternately offset. Further, in each sheaf, the first-page sheet of which image-formed face was turned downward is at the lowermost position, and the subsequent sheets are stacked upward in the page order.

The control for each mode as above is performed by the finisher control unit 501. The unit 501 discriminates the mode set based on the instruction from the CPU circuit unit 205 in the image formation unit 100, and drives and controls each unit according to procedure determined for the set mode.

A control process for the sheaf discharge operation of such the sheet process device (i.e., finisher) as having the above structure will be explained hereinafter.

The CPU 401 in the finisher control unit 501 communicates with the image formation apparatus 100 through the communication IC (IPC) to exchange the data, and performs various controls according to various programs stored in a not-shown ROM.

(Operation Mode Discrimination Process)

Figure 24:
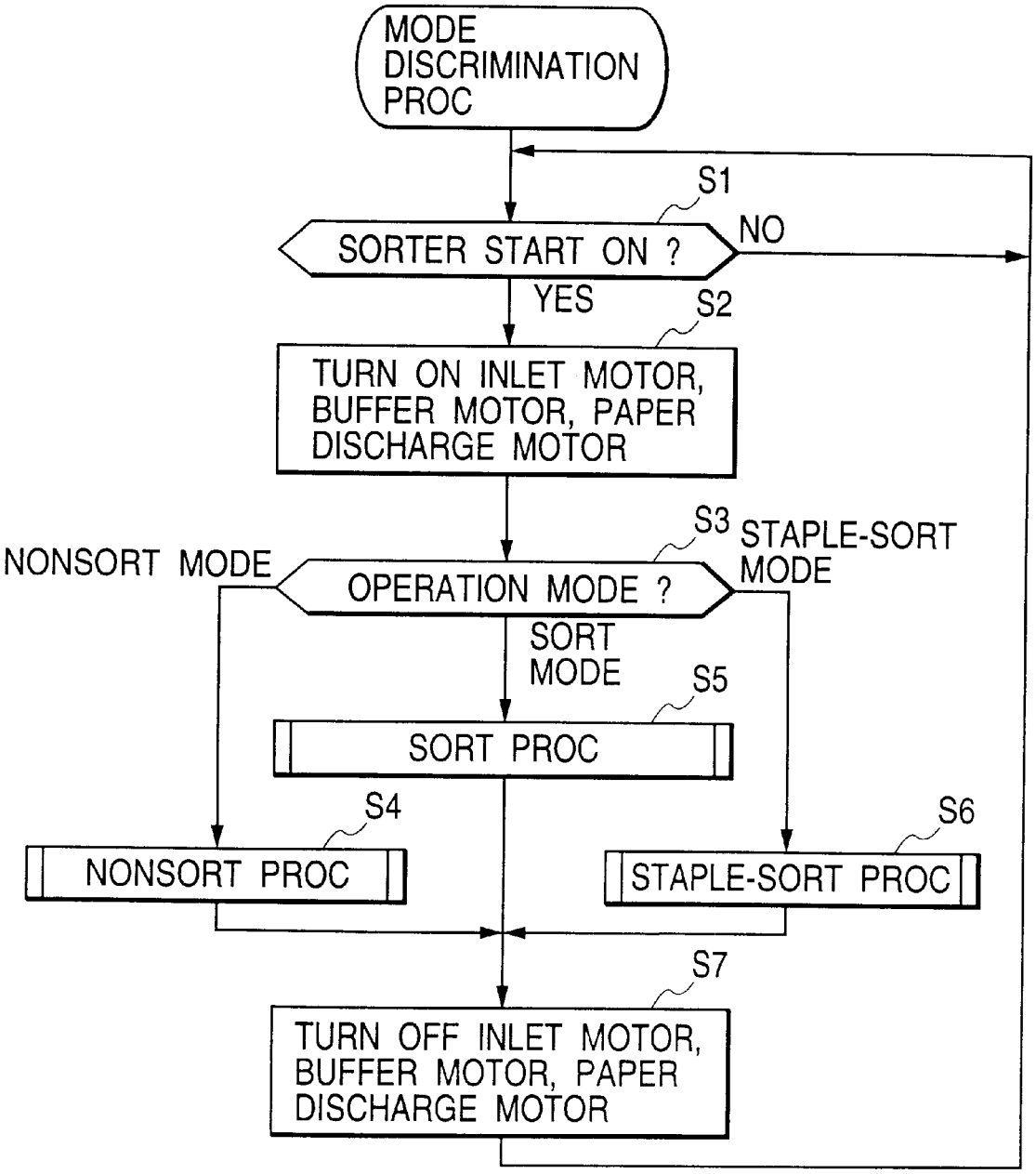
FIG. 24 is a flow chart showing a procedure in an operation mode discrimination process.

FIG. 24 is a flow chart showing a procedure in the operation mode discrimination process. A program for the operation mode discrimination process has been stored in a ROM (not shown) in the finisher control unit 501 and executed by the CPU 401.

Initially, it waits for the process until the finisher (i.e., sorter) starts (step S1). When a copy start key on the operation unit in the image formation apparatus body is depressed and the signal for starting the operation of the finisher is inputted from the apparatus body to the CPU 401 in the finisher control unit 501 through the communication IC (IPC), the finisher starts the operation. Thus, the CPU 401 starts driving the inlet motor M1, the buffer motor M2 and the paper discharge motor M3 (step S2). On the other hand, if the signal for starting the finisher is not inputted to the CPU 401, the finisher is on standby.

Subsequently, the operation mode is discriminated (step S3). If the operation mode is the nonsort mode, the nonsort process is executed (step S4). If the operation mode is the sort mode, the sort mode is executed (step 55). If the operation mode is the staple-sort mode, the staple-sort mode is executed (step S6).

When either one of the processes in the steps S4 to S6 terminates, then the driving of the inlet motor M1, the buffer motor M2 and the paper discharge motor M3 is stopped (step S7), and the flow returns to step S1. Thus, the finisher is on standby.

(Nonsort Process)

Figure 25:
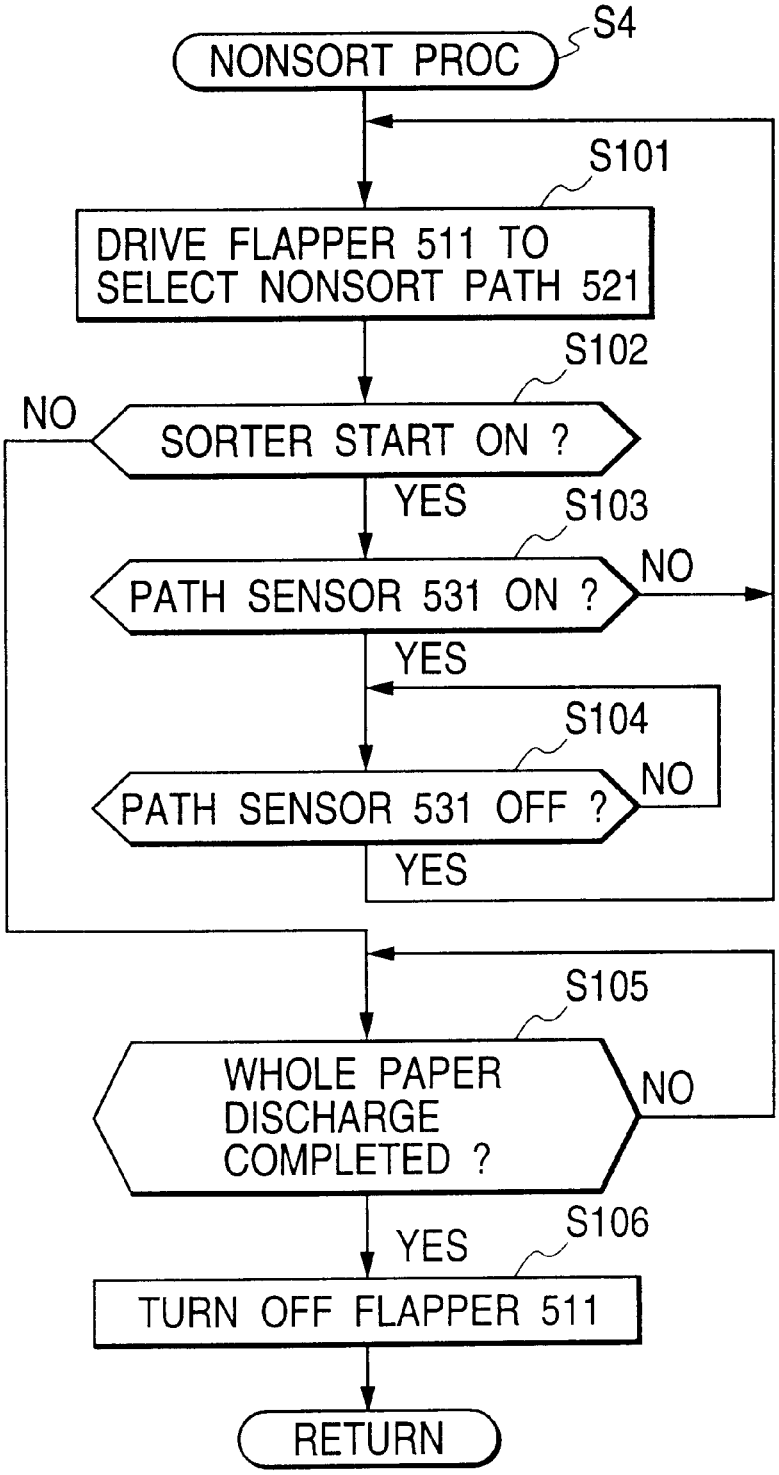
FIG. 25 is a flow chart showing a procedure in a nonsort process.

FIG. 25 is a flow chart showing a nonsort process procedure. The nonsort process is executed in the step S4, if it is discriminated in the step S3 that the operation mode is the nonsort mode. In the nonsort process, since the sheet P is initially guided onto the sample tray 701, the flapper 511 is driven to select the nonsort path 521 (step S101).

Then, it is judged whether or not the finisher starts the operation, i.e., the finisher is "ON" (step S102). If judged that the finisher is "ON", the sheet P discharged from the image formation apparatus body is carried to the paper path in the finisher. Then, it waits for the process until the sheet P is carried by the inlet motor M1, its leading edge is detected by the path sensor 531 in the path, and thus the sensor 531 comes to be "ON" (step S103). When the sensor 531 is "ON", then it waits for the process until the trailing edge of the sheet P exceeds the sensor 531, and thus the sensor 531 comes to be "OFF" (step S104).

When the sensor 531 is "OFF", then the flow returns to the step S102. Then, if the finisher is again "ON", the same processes as above are repeated. On the other hand, if the finisher is "OFF", it waits for the process until all the sheets are discharged onto the sample tray 701 (step S105). When all the sheets are completely discharged, then the operation of the flapper 511 is released (step S106), and the nonsort process terminates.

(Sort Process)

Figure 26:
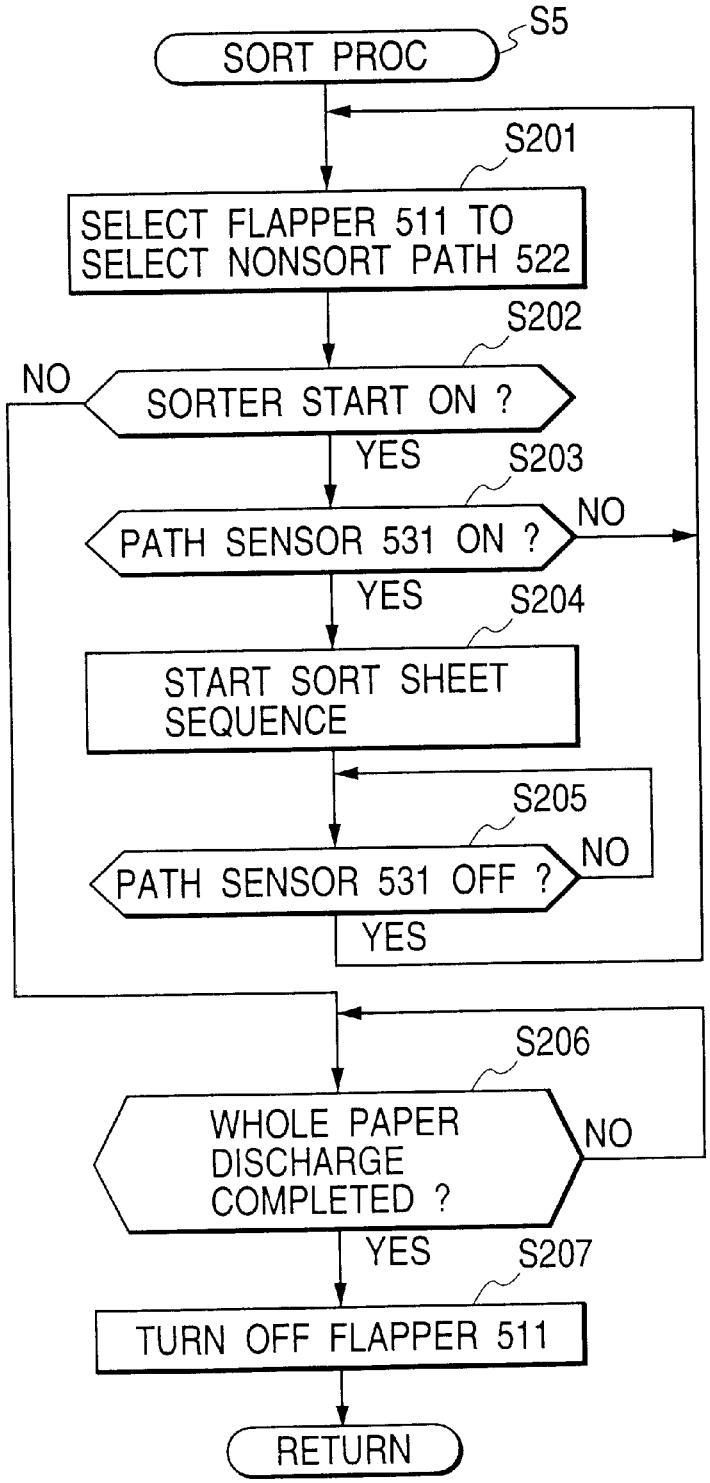
FIG. 26 is a flow chart showing a procedure in a sort process.

FIG. 26 is a flow chart showing a sort process procedure. The sort process is executed in the step S5, if it is discriminated in the step S3 that the operation mode is the sort mode.

In the sort process, since the sheet P is guided onto the process tray 630, the flapper 511 is initially driven to select the sort path 522 (step S201).

Then, it is judged whether or not the finisher is "ON" (step S202). If judged that the finisher is "ON", the sheet P discharged from the apparatus body is carried to the paper path in the finisher. Then, it waits for the process until the sheet P is carried by the inlet motor M1, and its leading edge is detected by the path sensor 531 in the path (step S203).

When the sensor 531 is "ON", a sort sheet sequence starts (step S204). Then, it waits for the process until the trailing edge of the sheet P exceeds the path sensor 531, and thus the sensor 531 comes to be "OFF" (step S205).

When the sensor 531 is "OFF", then the flow returns to the step S202. Then, if the finisher is again "ON", the same processes as above are repeated. On the other hand, if the finisher is "OFF", it waits for the process until all the sheets are discharged onto the process tray 630 (step S206). When all the sheets are completely discharged, then the operation of the flapper 511 is released (step S207), and the sort process terminates.

(Staple-Sort Process)

Figure 27:
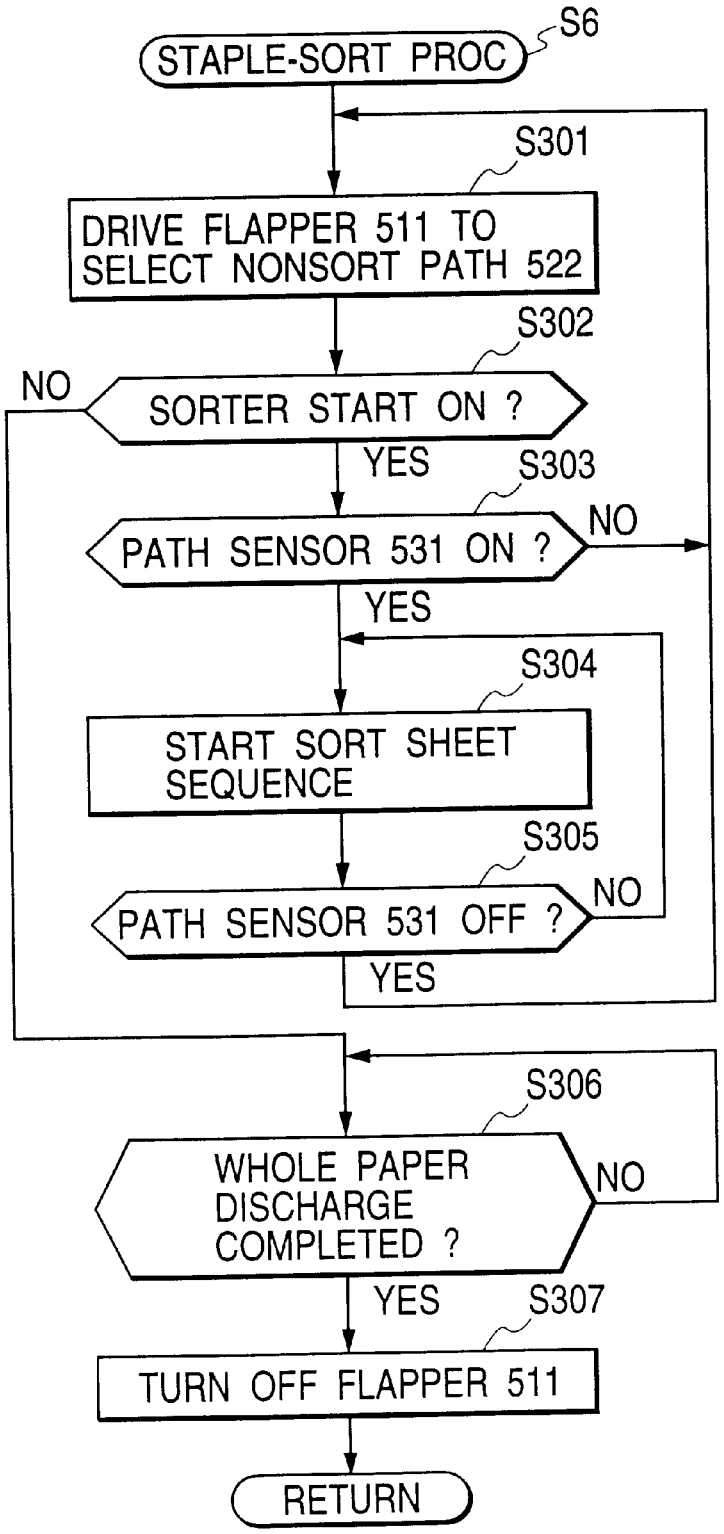
FIG. 27 is a flow chart showing a procedure in a staple-sort process.

FIG. 27 is a flow chart showing a staple-sort process procedure. The staple-sort process is executed in the step S6, if it is discriminated in the step S3 that the operation mode is the staple-sort mode.

In the staple-sort process, since the sheet P is guided onto the process tray 630, the flapper 511 is initially driven to select the sort path 522 (step S301). Then, it is judged whether or not the finisher is "ON" (step S302). If judged that the finisher is "ON", the sheet P discharged from the apparatus body is carried to the paper path in the finisher.

Then, it waits for the process until the sheet P is carried by the inlet motor M1, its leading edge is detected by the path sensor 531 in the path, and thus the sensor 531 comes to be "ON" (step S303). When the sensor 531 is "ON", the sort sheet sequence starts (step S304).

Further, it waits for the process until the sheet P is carried, its trailing edge exceeds the sensor 531, and thus the sensor 531 comes to be "OFF" (step S305). When the sensor 531 is "OFF", then the flow returns to the step S302. If the finisher is again "ON", the same processes as above are repeated. On the other hand, if the finisher is "OFF", it waits for the process until all the sheets are discharged onto the process tray 630 (step S306). When all the sheets are completely discharged, then the operation of the flapper 511 is released (step S307), and the staple-sort process terminates.

(Sort Sheet Sequence Process)

Figure 28:
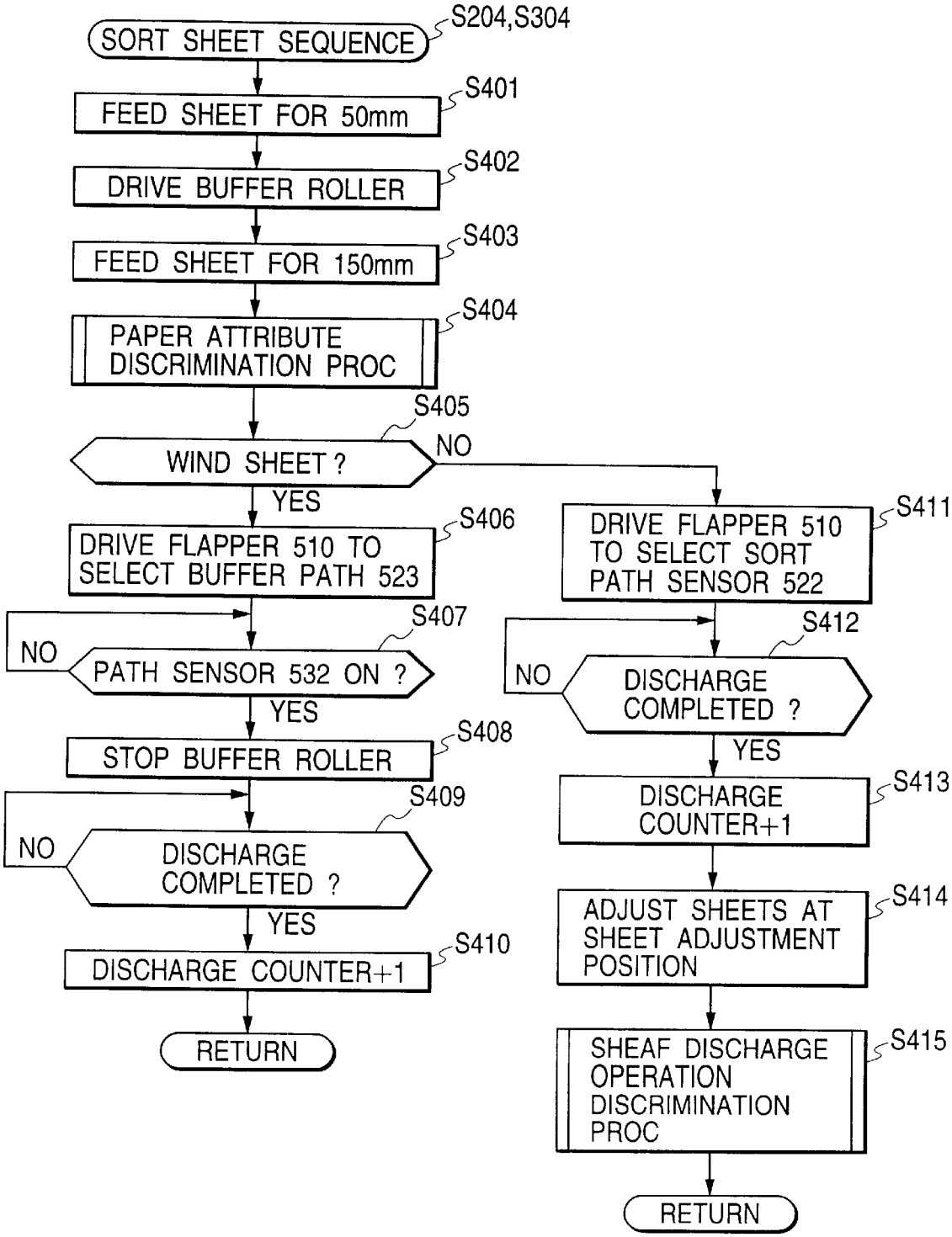
FIG. 28 is a flow chart showing a procedure in a sort sheet sequence process.

FIG. 28 is a flow chart showing a sort sheet sequence process procedure. The sort sheet sequence process is executed in the step S204 in the above sort process and the step S304 in the above staple-sort process, and allocated to every sheet carried. Further, a program for this process is a multitask program and executed by the CPU 401.

In the sort sheet sequence process, initially, the sheet is carried for 50 mm (step S401), and the buffer motor starts driving the buffer roller (step S402). In this case, since the sort sheet sequence starts in response to "ON" of the path sensor 531, the buffer motor starts the operation at the time when the leading edge of the sheet is carried for 50 mm toward the downstream side from the position at which the path sensor 531 was turned on.

Such start timing is necessary to carry the subsequent sheets, and also necessary to restart carrying "wind sheet" wound around the buffer roller and standing thereon. By this start timing, the sheet overlaid on the wind sheet can be carried together with the wind sheet.

Although "50 mm" is described as a condition to define the above timing in the embodiment, such the condition can be arbitrarily set. After then, the sheet is carried for 150 mm (step S403), and a paper attribute discrimination process is performed (step S404). Although the paper attribute discrimination process will be later explained in detail, roughly this process is to discriminate an attribute of the carried sheet between "whether the sheet is to be wound (i.e., wind sheet)" and "whether the sheet is to be used for the sheaf discharge after the sheaves are stacked on the process tray".

As a result of the paper attribute discrimination process, it is judged whether or not the sheet is the wind sheet (step S405). If judged that the sheet is designated as the wind sheet, the flapper 510 is driven to select the buffer path 523 (step S406). Then, if the sheet is carried as it is, the sheet can be guided to the buffer path 523 for winding the sheet around the buffer roller.

Subsequently, buffer motor stop control starts at the time when the path sensor 532 on the buffer path 523 is turned on, and the sheet is wound around the buffer roller (steps S407 and S408). When the leading edge of the sheet exceeds the path sensor 532, then the buffer roller is stopped. In this case, when sheet attachment control is performed, the buffer roller is stopped in consideration of an overrun amount.

After stopping the buffer roller, the wound sheet is on standby as it is until the buffer roller restarts the rotation to wind thereon the subsequent sheet. After the roller restarts, at a time when the sheet discharge onto the tray completes (step S409), a value of a discharge counter for counting the number of sheets discharged onto the process tray is increased by "1", and the process terminates (step S410).

On the other hand, if judged in the step S405 that the sheet is not the wind sheet, the flapper 510 is driven to select the sort path 522 (step S411). By selecting the sort path 522, the sheet is guided not to the buffer path 523 but to the path being the paper discharge path to the process tray.

Then, after the completion of the discharge onto the process tray is confirmed (step S412), the value of the discharge counter is increased by "1" (step S413), and the sheet is adjusted at the adjustment position defined for each sheet by the two adjustment members (step S414). When the sheet is discharged onto the process tray, the sheet is adjusted or aligned in a direction substantially perpendicular to the sheet carrying direction and the paddle is rotated at the same time when the sheet is discharged, thereby adjusting the sheet in its carrying direction.

After then, a later-described sheaf discharge operation discrimination process is performed (step S415), and the process terminates.

(Paper Attribute Discrimination Process)

Figure 29:
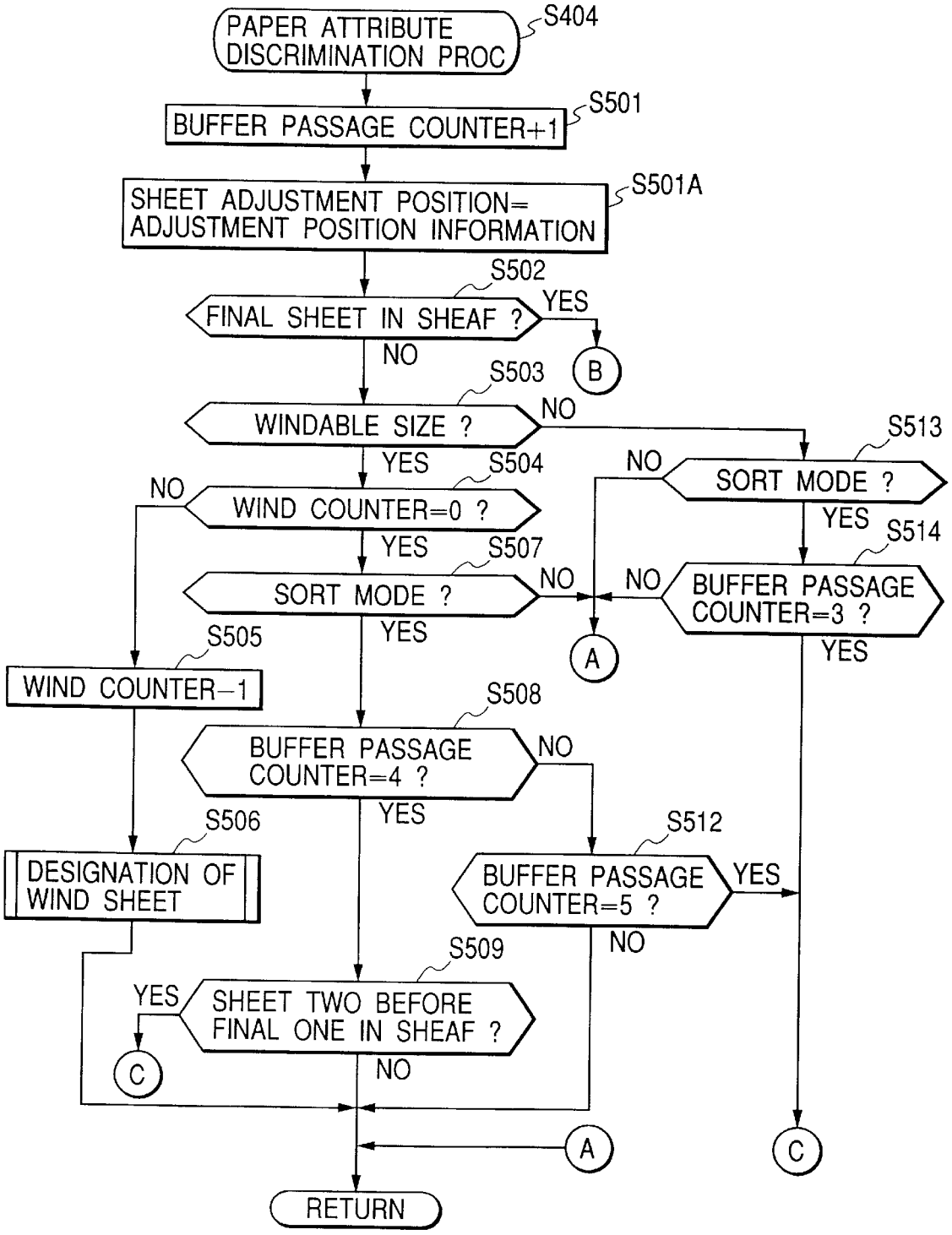
FIG. 29 is a flow chart showing a procedure in a paper attribute discrimination process.
Figure 30:
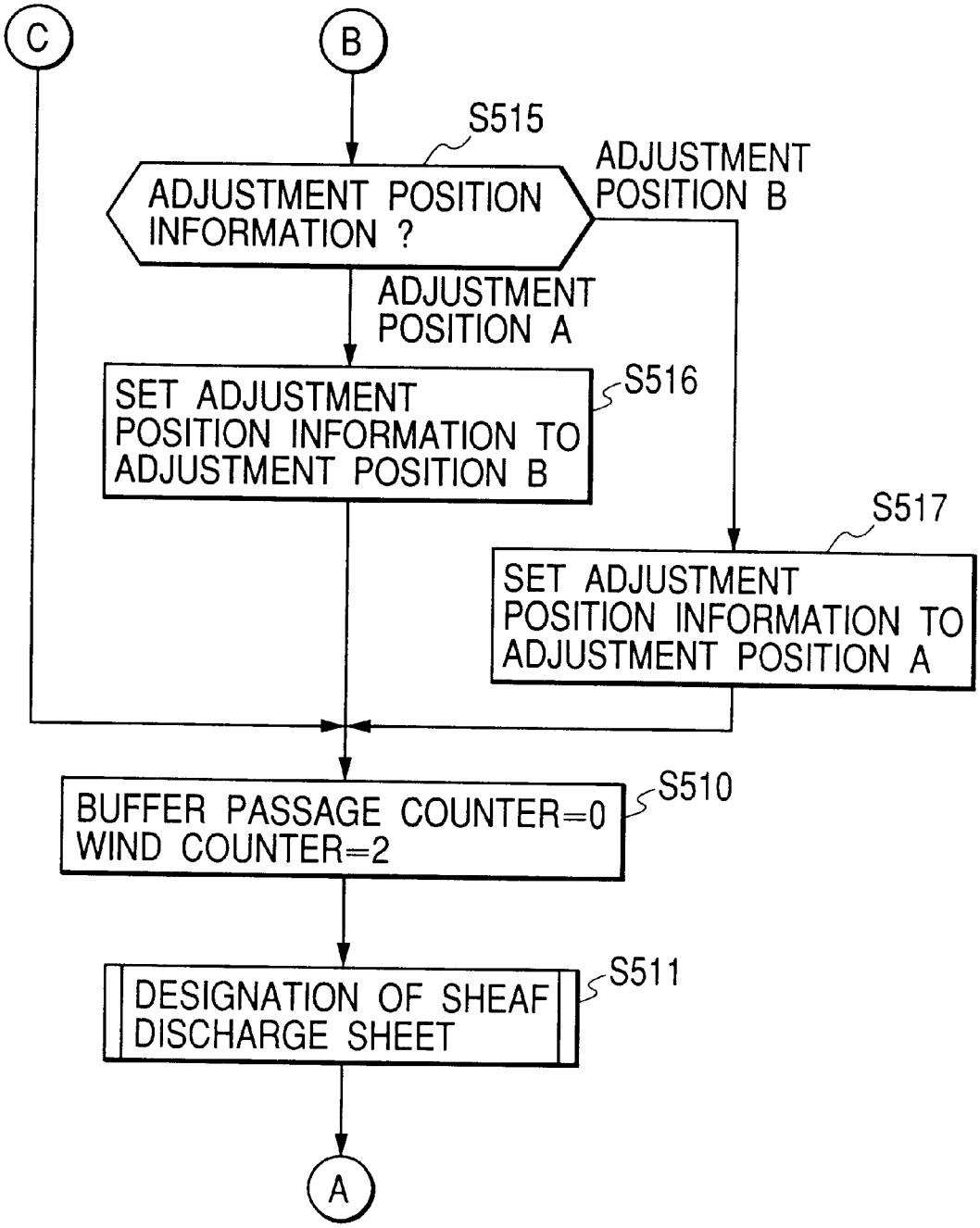
FIG. 30 is a flow chart showing a procedure in the paper attribute discrimination process subsequent to the procedure shown in FIG. 29.

FIGS. 29 and 30 are flow charts showing a procedure in the paper attribute discrimination process. The paper attribute discrimination process is executed in the step S404 in the above sort sheet sequence process.

Initially, a value of a buffer passage counter for counting the number of sheets passed through the buffer roller is increased by "1" (step S501). When the sheet is discharged onto the process tray, information representing which of the front side and the rear side the sheet is adjusted to sort the sheaf is set as information (representing sheet adjustment position) for each sheet (step S501A).

Subsequently, it is judged whether or not the sheet is final sheet in one sheaf (step S502). In this case, one sheaf is a unit for the sort in the sort mode, or a unit for the stapling in the staple-sort mode.

If judged that the sheet is not the final sheet, it is further judged whether the sheet has a size (windable size) capable of being wound around the roller (step S503). If judged that the sheet has the windable size, a wind counter for counting the number of windable sheets is referred. Thus, it is further judged whether or not a value of the wind counter is "0" (step S504).

If judged that the value of the wind counter is not "0", such the value is decreased by "1" (step S505), and the sheet is designated as "wind sheet" (step S506). Here the object to wind the sheet around the buffer roller is to temporarily stagnate the discharged sheet such that this sheet is discharged together with the subsequent sheet to give a sufficient time for the process at the downstream side. Namely, the object is to improve productivity.

If judged in the step S504 that the value of the wind counter is "0", it is further judged whether or not the operation mode is the sort mode (step S507). If judged that the operation mode is not the sort mode, i.e., the operation mode is the staple-sort mode, the process terminates. On the other hand, if judged that the operation mode is the sort mode, it is further judged whether or not the value of the buffer passage counter is "4" (sep S508). If judged that the value is "4", it is further judged whether or not the carried sheet is the sheet two before the final sheet in the sheaf (step S509).

If judged that the carried sheet is the sheet two before the final sheet in the sheaf, the value of the buffer passage counter is set to be "0" and the value of the wind counter is set to be "2" (step S510), and "sheaf discharge sheet" representing that the sheaf discharge is performed from the process tray is designated on the carried sheet(step S511). If judged that the value of the buffer passage counter is "5", also "sheaf discharge sheet" is designated (step S512). In other cases, the process terminates as it is.

Such the control has a following meaning for the operation in the sort mode and the windable size (A4, LTR, B5 in the embodiment). That is, the sheaf discharge operation is basically the operation "to discharge every five sheets from the process tray". However, only in the case where "the fourth sheet on the process tray is also the sheet two before the final sheet in the sheaf", i.e., only in the case where "every five sheets are discharged from the process tray" and the case where "final one of the sheets is the sheaf discharge sheet", the sheaf discharge operation is the operation to perform the sheaf discharge from the process tray with four sheets. When the sheet discharge with four sheets is performed, the sheet one before the final sheet in the subsequent sheaf is the wind sheet, and this wind sheet is discharged together with the final sheet, whereby the sheet discharge is performed.

By performing such the control, in case of performing the sheet discharge operation from the process tray, it becomes possible to always wind the subsequent sheet. At this time, at least the process time (between leading edge of sheet and leading edge of next sheet) for one sheet can be secured extra. Therefore, high productivity can be realized in the sheaf discharge operation which requires the relatively longer operation time as compared with the case where each sheet is discharged.

Although the sheaf discharge operation is described in the embodiment, the present invention is not limited to this. For example, the present invention is applicable to a staple operation, exclusive control for sheets in a carrier driving system, and the like. In these cases, such high productivity as in the present invention can be also realized.

On the other hand, if judged in the step S503 that the sheet does not have the windable size, it is further judged whether or not the operation mode is the sort mode (step S513).

If the operation mode is not the sort mode but is the staple-sort mode, the process terminates. On the other hand, if the operation mode is the sort mode, it is judged whether or not the value of the buffer passage counter is "3" (step S514). If the value is not "3", the process terminates. On the other hand, if the value is "3", the process in the above step S510 is performed.

The processes in the above steps S510 and S511 are the process to designate the carried sheet as "sheaf discharge sheet" representing the sheet to be sheaf-discharged and the accompanied counter setting process (to clear buffer passage counter and set wind counter). In this case, to designate "sheaf discharge sheet" means that the sheaf discharge operation from the process tray to the stack tray starts when the carried sheets are discharged and stacked on the process tray, and such designation is used in a later-described sheaf discharge operation discrimination process.

On the other hand, if judged in the step S502 that the carried sheet is the final sheet in the sheaf, the already-set adjustment position information is reversely set. The adjustment position information is set for each sheet. Therefore, for example, if it is assumed that the front-side position is an adjustment position A and the rear-side position is an adjustment position B, the currently set adjustment position information is discriminated (step S515). If the information represents the position A, the adjustment position information is set to represent the position B (step S516). On the other hand, if the information represents the position B, the information is set to represent the position A (step S517). As above, by reversing the adjustment position information, it becomes possible to sort (or offset) each sheaf on the process tray and the stack tray. After then, the flow advances to the above step S510.

According to the processes as described above, the discrimination and setting processes for the attribute concerning the sheet (i.e., whether wind control is to be performed, whether sheaf discharge is to be performed) complete.

(Sheaf Discharge Operation Discrimination Process)

Figure 31:
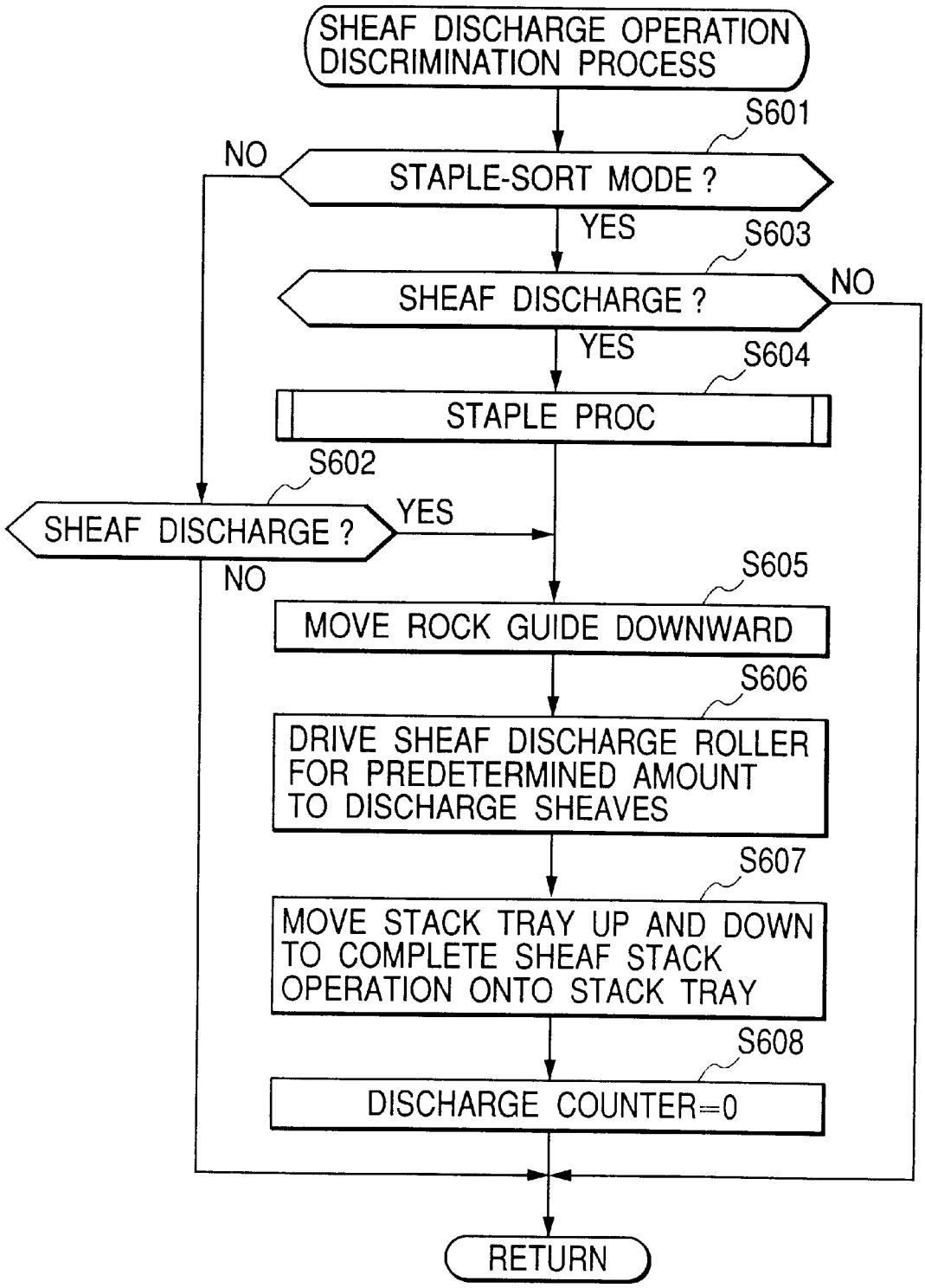
FIG. 31 is a flow chart showing a procedure in a sheaf discharge operation discrimination process.

FIG. 31 is a flow chart showing a procedure in the sheaf discharge operation discrimination process. The sheaf discharge operation discrimination process is executed in the step S415 in the above sort sheet sequence process.

In this process, initially it is judged whether or not the operation mode is the staple-sort mode (step S601). If judged that the operation mode is not the staple-sort mode, it is further judged whether or not the sheet discharged onto the process tray 630 is the sheaf discharge sheet (step S602). If judged that the discharged sheet is not the sheaf discharge sheet, the process terminates and the flow returns to the above sort sheet sequence process.

On the other hand, if judged in the step S602 that the discharged sheet is the sheaf discharge sheet, the rock guide 650 is driven such that the discharge roller 680*a* comes into contact with the sheaf on the process tray 630 (step S605). Then, after the bound of the discharge roller 680*b* ends, the roller 680*b* is driven for a predetermined amount, and as a speed of a sheaf discharge motor M180 is controlled, the sheaf on the process tray 630 is discharged onto the stack tray 700 (step S606).

Subsequently, the stack tray 700 is moved up and down to complete the sheaf stacking onto the tray 700 (step S607). After then, the value of the discharge counter is set to be "0" (step S608), and the process terminates.

On the other hand, if judged in the step S601 that the operation mode is the staple-sort mode, it is further judged whether or not the sheet discharged on the process tray 630 is the sheaf discharge sheet (step S603). If judged that the discharged sheet is not the sheaf discharge sheet, the process terminates, and the flow returns to the above sort sheet sequence process. On the other hand, if judged that the discharged sheet is the sheaf discharge sheet, the flow advances to a staple process sequence (step S604). After the staple process for the sheaf on the process tray 630 terminates, the flow advances to the above step S605 to move the rock guide 650 downward, thereby performing the above sheaf discharge operation (steps S605 to S608). After then, the process terminates and the flow returns to the sort sheet sequence.

(Staple Process)

Figure 32:
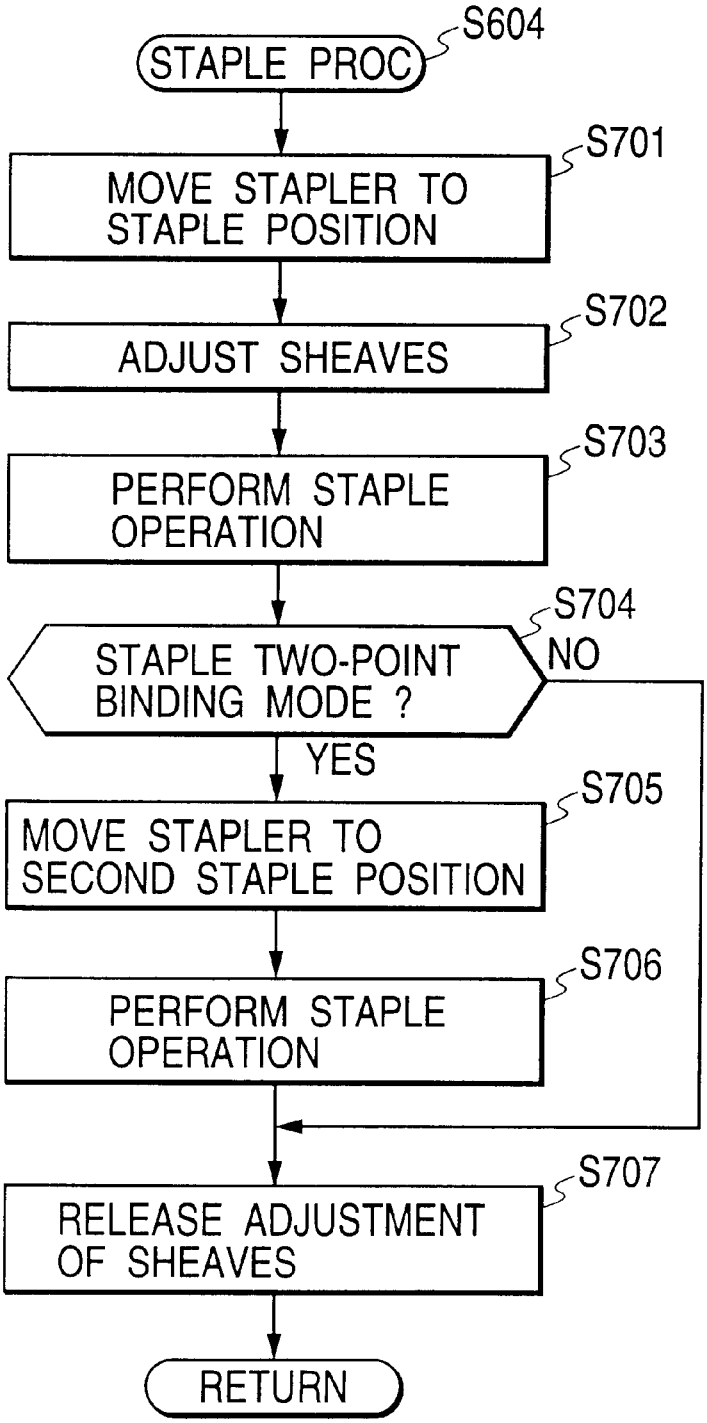
FIG. 32 is a flow chart showing a procedure in a staple process.

FIG. 32 is a flow chart showing a procedure in the staple process. The staple process is executed in the step S604 in the above sheaf discharge operation discrimination process.

In the staple process, initially the stapler 601 is moved for a predetermined amount up to a staple position (step S701), the sheaf on the process tray 630 is then adjusted or aligned by an adjustment means 640 composed of the front-side and rear-side adjustment members 641 and 642 (step S702), and the staple operation for a (first) staple point is performed (step S703).

Then, it is judged whether or not the binding mode is the staple two-point binding mode (step S704). If judged that the binding mode is not the two-point binding mode, the adjustment for the sheaf by the adjustment means 640 is released (step S707), and the staple process terminates.

On the other hand, if judged in the step S704 that the binding mode is the staple two-point binding mode, the stapler 601 is moved for a predetermined amount up to a second staple position (step S705), and the staple operation for a second staple point is performed (step S706). Then, the adjustment for the sheaf by the adjustment means 640 is released (step S707), and the staple process terminates.

Figure 33A:
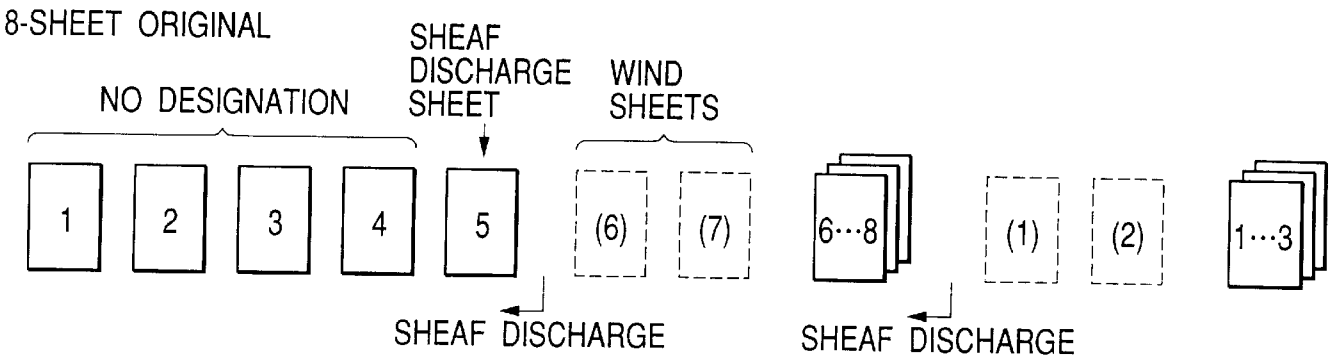
FIGS. 33A, 33B and 33C are views showing a concrete example of a sheaf discharge operation.
Figure 33B:
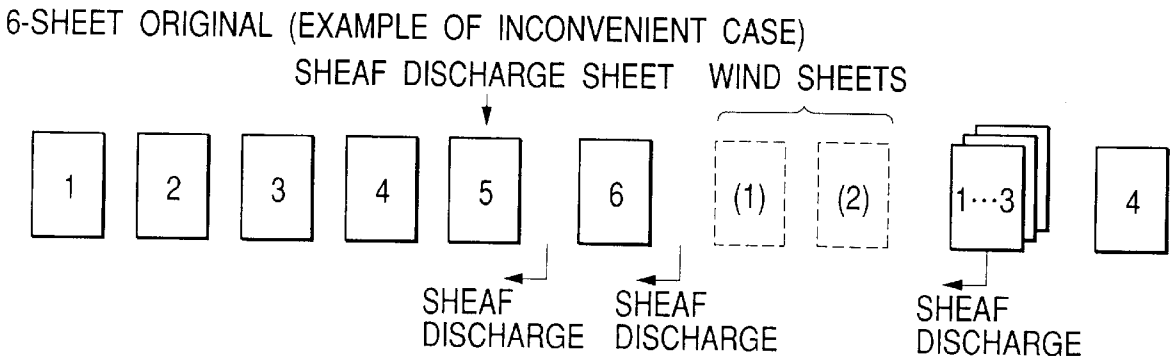
Figure 33C:
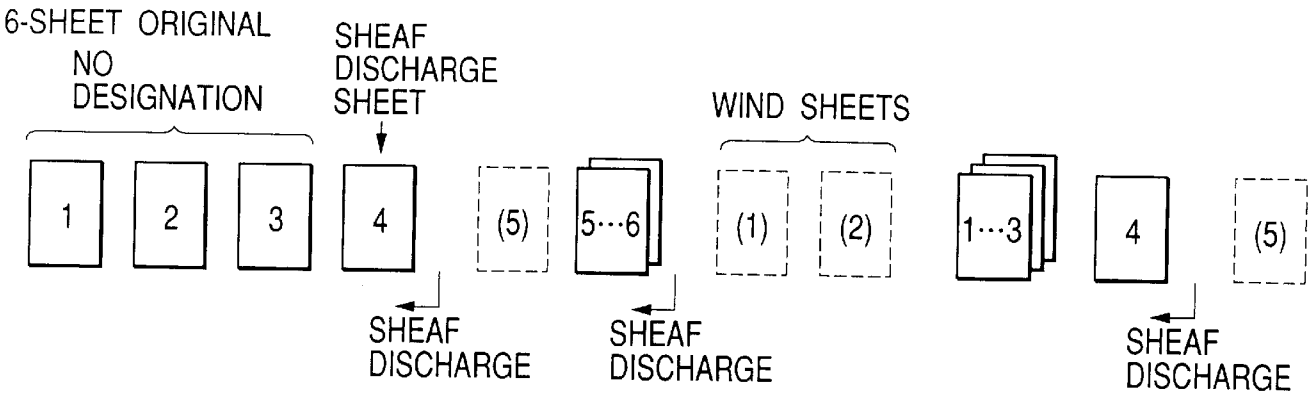

Subsequently, a concrete example of the sheaf discharge operation will be explained on the basis of the paper attribute discrimination process. FIGS. 33A to 33C are views showing the concrete example of the sheaf discharge operation.

FIG. 33A shows a case where the sheaf discharge operation is performed on the original of eight pages (i.e., sheets). In this case, any sheet designation is not performed on the sheets (numbers 1 to 4) corresponding to first to fourth pages of the original, the value of the buffer passage counter is counted up to "4" (step S501), and the sheets are stacked on the process tray as there are (step S512).

The following sheet (number 5) corresponding to fifth page of the original is designated as the sheaf discharge sheet (steps S512 and S511). When this sheet is stacked on the process tray, then the sheaf discharge operation for the first to fifth pages of the original is performed.

The following sheets (numbers 6 and 7) corresponding to sixth and seventh pages of the original are designated as the wind sheets (step S506), and these sheets are wound around the buffer roller. When the sixth and seventh sheets are stacked on the process tray together with the sheet which corresponds to eighth page of the original and is designated as the final sheet of the sheaf discharge sheet (steps S502 and S511), the sheaf discharge operation for the sixth to eighth page of the original is performed.

When the sheaf discharge operation of the final sheet is performed, then the value of the wind counter is set to be "2" (step S510). Therefore, the sheets corresponding to first and second pages in the next original are designated as the wind sheets, and the similar sheaf discharge operation for these sheets is performed.

FIG. 33C shows a case where the sheaf discharge operation is performed on the original of six pages (i.e., sheets). In this case, like the case of the eight-page original, any sheet designation is not performed on the sheets corresponding to first to third pages of the original, and these sheets are stacked on the process tray as there are (step S512). Since the sheet corresponding to following fourth page of the original is the sheet two before the final sheet in the sheaf (step S509), such the fourth sheet is designated as the sheaf discharge sheet (step S511), and the sheaf discharge operation for the first to fourth pages of the original is performed.

In case of performing the designation operation for the sheaf discharge sheet, since the value of the wind counter is "2" (step S510), the sheet corresponding to fifth page of the original is designated as the wind sheet (step S506) and also designated as the final sheet of the sheaf discharge sheet (step S511). When such the fifth sheet is stacked on the process tray together with the sheet corresponding to sixth page of the original, then the sheaf discharge operation is performed. The sheets corresponding to first and second pages of the following sheaf (i.e., original) are designated as the wind sheets.

As described above, by performing the sheaf discharge operation in which the wind sheet and the sheaf discharge sheet are designated, the next or following sheet is not discharged onto the process tray while the sheaf of sheets stacked on the process tray is being discharged onto the stack tray. Also, the sheaf discharge operation can be performed without stopping the body itself of the operation of the image formation apparatus. Moreover, since the sheaf discharge operation is performed according to the sheet two before the final sheet in the sheaf, it can be prevented that the sheaf discharge operation is performed as the final sheet in one sheaf and the first sheet in next sheaf overlap each other.

In the step S509 (in case of six-page original), if the sheaf discharge is not performed according to the sheet two before the final sheet in the sheaf, as shown in FIG. 33B, the final (i.e., sixth) sheet in the sheaf is wound around the buffer roller while the sheaf discharge operation for the first to fifth sheets is being performed, and such the sixth sheet is discharged onto the process tray together with the first sheet in the next sheaf, whereby the sort (offset) operation can not be normally performed.

In the embodiment, the two sheets are wound around the buffer roller, and the sheaf discharge operation is performed when the sheet two before the final sheet of the sheaf is discharged onto the process tray. However, in a case where B sheets of paper can be wound around the buffer roller, the sheaf discharge operation may be performed when any one of the sheets (B+1) to two before the final sheet of the sheaf is stacked on the process tray. That is, in case of the six-page original shown in FIG. 33C, the sheaf discharge operation may be performed when the sheet of the number "3" is stacked on the process tray. If doing so, the sheets of the numbers "4" and "5" are wound around the buffer roller and then stacked on the tray together with the final sheet of the number "6".

Further, in the embodiment, the two sheets are wound around the buffer roller and then stacked on the process tray together with the following third sheet. However, the number of sheets to be wound is not limited to two, but the single or the three or more sheets may be wound around the roller. That is, such the number may be appropriately set according to the carrying speed of the sheet sent from the image formation apparatus body to which a sheet postprocess device is installed, the sheaf discharge operation, and the like.

As explained above, in the mode not to perform the binding process, the sheaf discharge operation is performed according as the predetermined number of sheets are stacked on the process tray or according as final one of the sheets constituting a group is stacked on the process tray. Therefore, the sheaf discharge operation can be performed without breaking the sheaves of sheets stacked on the stack tray.

Further, in the case where the sheets on the process tray are adjusted or aligned at either the first adjustment position or the second adjustment position by the adjustment members, the adjustment position defined by the adjustment member is changed according as the final one of the sheets constituting the group is stacked on the stack tray. Therefore, the sheaf discharge operation can be performed in such the state as the sheets have been adjusted in each sheaf (i.e., group).

Furthermore, in the case where the sheet is once stagnated in the buffer path and then carried to the process tray, it is controlled that the sheet is stagnated in the buffer path according as the binding process starts or the sheaf discharge operation starts. Therefore, in case of performing the sheaf discharge operation, the next or following sheet is not discharged onto the process tray while the sheaf of sheets stacked on the process tray is being discharged onto the stack tray, and also the operation of the image formation apparatus body is not stopped during such the operation.

Furthermore, in the case where the sheaf is discharged from the process tray, such the sheaf discharge operation is performed according as a second predetermined number of sheets smaller than a first predetermined number of sheets are stacked on the process tray when the sheet size is larger than a predetermined size. Therefore, the sheaf discharge operation for the sheets of which size is large can be performed with the sheaf having the small number of sheets. Thus, the sorting can be easily performed without breaking the sheaves of sheets stacked on the stack tray.

What is claimed is:

1. A sheet process device comprising:

first stack means for stacking thereon sheets discharged from an image forming apparatus;

binding process means for performing a binding process on the sheets stacked on said first stack means;

second stack means for stacking thereon the sheets transferred from said first stack means;

a transfer unit for transferring the sheets from said first stack means to said second stack means; and transfer control means for driving said transfer unit when a last sheet of one group is stacked on said first stack means, wherein, in a mode not to perform the binding process by said binding process means, when the sheets of a group composed of the sheets of which the number exceeds said predetermined number are stacked on said first stack means, even if the last page of said group is not stacked on said first stack means, said transfer control means drives said transfer unit when the sheets of which the number corresponds to said predetermined number are stacked on said first stack means, and in a mode to perform the binding process by said binding process means, when the sheets of a group composed of the sheets of which the number exceeds said predetermined number are stacked on said first stack means, said transfer control means does not drive said transfer unit even if the sheets of which the number corresponds to said predetermined number are stacked on said first stack means, but drives said transfer unit when the last page of said group is stacked on said first stack means.

2. A device according to claim 1, further comprising:

adjustment means for adjusting the sheets on said first stack means at either one of a first adjustment position and a second adjustment position; and adjustment control means for changing the adjustment position of said adjustment means when the last sheet of the group is stacked on said second stack means.

3. A device according to claim 1, further comprising:

stagnation means, provided on an upstream side of said first stack means, for stagnating the discharged sheets;

carrier means for carrying the sheets to said first stack means without stagnating them in said stagnation means, and carrying the sheets to said first stack means after stagnating them in said stagnation means; and carrier control means for controlling said carrier means to cause said stagnation means to stagnate the sheets when said binding process means starts the binding process and when said transfer unit starts the sheet transfer.

4. A sheet process device comprising:

stagnation means for stagnating received sheets;

first stack means for stacking thereon the sheets;

carrier means for carrying the sheets to said first stack means without stagnating them in said stagnation means, and carrying the sheets to said first stack means after stagnating them in said stagnation means;

second stack means for stacking thereon the sheets transferred from said first stack means;

a transfer unit for transferring the sheets from said first stack means to said second stack means;

transfer control means for driving said transfer unit when a predetermined number of sheets are stacked on said first stack means and when a last sheet of one group is stacked on said first stack means; and carrier control means for controlling said carrier means to cause said stagnation means to stagnate the sheets when said transfer unit transfers the sheets, wherein said transfer control means drives said transfer unit when a third to last sheet of the group is stacked on said first stack means, even if the predetermined number of sheets are not stacked on said first stack means.

5. A device according to claim 4, wherein said carrier control means causes said stagnation means to stagnate a second last sheet of the group.

6. A device according to claim 4, wherein said carrier control means carries the sheets stagnated in said stagnation means to said first stack means, together with the last sheet of the group.

7. A device according to claim 4, further comprising:

adjustment means for adjusting the sheets on said first stack means at either one of a first adjustment position and a second adjustment position; and adjustment control means for changing the adjustment position of said adjustment means when the last sheet of the group is stacked on said second stack means.

8. A sheet process device comprising:

stagnation means capable of stagnating B sheets received;

first stack means for stacking thereon the sheets;

carrier means for carrying the sheets to said first stack means without stagnating them in said stagnation means, and carrying together with newly received sheets the sheets to said first stack means after stagnating at least one of the sheets in said stagnation means;

second stack means for stacking thereon the sheets transferred from said first stack means;

a transfer unit for transferring the sheets from said first stack means to said second stack means;

transfer control means for driving said transfer unit when a predetermined number of sheets are stacked on said first stack means and when a last sheet of one group is stacked on said first stack means; and carrier control means for controlling said carrier means to cause said stagnation means to stagnate the sheets when said transfer unit transfers the sheets, wherein said transfer control means drives said transfer unit when any one of sheets from a (B+2)-th last sheet to a third to last sheet of the group is stacked on said first stack means, even if the predetermined number of sheets are not stacked on said first stack means.

9. A device according to claim 8, wherein said carrier control means carries the sheets stagnated in said stagnation means to said first stack means, together with the last sheet of the group.

10. A device according to claim 8, further comprising:

adjustment means for adjusting the sheets on said first stack means at either one of a first adjustment position and a second adjustment position; and adjustment control means for changing the adjustment position of said adjustment means when the last sheet of the group is stacked on said second stack means.

11. A sheet process device comprising:

stagnation means for stagnating received sheets;

first stack means for stacking thereon the sheets;

carrier means for carrying the sheets to said first stack means without stagnating them in said stagnation means, and carrying the sheets together with newly received sheets to said first stack means after stagnating at least one of the sheets in said stagnation means;

second stack means for stacking thereon the sheets transferred from said first stack means;

transfer unit for transferring the sheets from said first stack means to said second stack means;

transfer control means for driving said transfer unit when a predetermined number of sheets are stacked on said first stack means and when a last sheet of one group is stacked on said first stack means; and carrier control means for controlling said carrier means to cause said stagnation means to stagnate the sheets when the predetermined number of sheets are stacked on said first stack means and when the last sheet of the group is stacked on said first stack means, wherein said carrier control means controls said carrier means to cause said stagnation means to stagnate at least a second to last sheet of the group, even if the predetermined number of sheets are not stacked on said first stack means.

12. A sheet processing method comprising the steps of:

stacking discharged sheets on first stack means for stacking;

binding the sheets stacked on the first stack means;

stacking sheets transferred from the first stack means onto second stack means for stacking;

transferring the sheets from the first stack means to the second stack means using a transfer unit; and driving the transfer unit when a last sheet of one group is stacked on the first stack means, wherein, in a mode not to perform the binding process, when the sheets of a group composed of the sheets of which the number exceeds said predetermined number are stacked on the first stack means, even if the last page of said group is not stacked on the first stack means, the transfer unit is driven when the sheets of which the number corresponds to said predetermined number are stacked on the first stack means, and in a mode to perform the binding process, when the sheets of a group composed of the sheets of which the number exceeds said predetermined number are stacked on the first stack means, the transfer unit is not driven even if the sheets of which the number corresponds to said predetermined number are stacked on the first stack means, but the transfer unit is driven when the last page of said group is stacked on the first stack means.

13. A method according to claim 12, further comprising the steps of:

adjusting the sheets on the first stack means at either one of a first adjustment position and a second adjustment position; and changing the adjustment position when the last sheet of the group is stacked on the second stack means.

14. A method according to claim 12, further comprising the steps of:

stagnating the received sheets on an upstream side of the first stack means;

carrying the sheets to the first stack means without said stagnating and carrying the sheets to the first stack means after said stagnating; and controlling said carrying of the sheets to cause said stagnating of the sheets when said binding is started and when said transferring is started.

15. A sheet processing method comprising the steps of:

stagnating sheets received from an image forming apparatus by stagnating means capable of stagnating B sheets;

stacking the sheets on first stack means for stacking;

carrying the sheets to the first stack means without said stagnating and carrying the sheets together with newly received sheets to the first stack means after said stagnating of at least one of the sheets;

stacking sheets transferred from the first stack means onto second stack means for stacking;

transferring the sheets from the first stack means to the second stack means using a transfer unit;

driving the transfer unit when a predetermined number of sheets are stacked on the first stack means and when a last sheet of one group is stacked on the first stack, means; and controlling said carrying of the sheets to cause said stagnating of the sheets when said transferring step transfers the sheets, wherein said driving of the transfer unit is controlled by said controlling step when any one of the sheets from a (B+2)-th last sheet to a third to last sheet of the group is stacked on the first stack means, even if the predetermined number of sheets are not stacked on the first stack means.

16. A method according to claim 15, wherein said controlling includes controlling said carrying of the stagnated sheets to the first stack means together with a last sheet of the group.

17. A method according to claim 15, further comprising the steps of:

adjusting the sheets on the first stack means at either one of a first adjustment position and a second adjustment position; and changing the adjustment position when the last sheet of the group is stacked on the second stack means.

18. A sheet process device comprising:

a first tray for stacking thereon sheets discharged from an image forming apparatus;

a binder for performing a binding process on the sheets stacked on said first tray;

a second tray for stacking thereon the sheets transferred from said first tray;

a transfer unit for transferring the sheets from said first tray to said second tray; and a controller for driving said transfer unit in accordance with a last sheet of one group is stacked on said first tray, wherein, in a mode not to perform the binding process by said binder, when the sheets of a group composed of the sheets of which the number exceeds said predetermined number are stacked on said first tray, even if the last page of said group is not stacked on said first tray, said controller drives said transfer unit in accordance with that the sheets of which the number corresponds to said predetermined number are stacked on said first tray, and in a mode to perform the binding process by said binder, when the sheets of a group composed of the sheets of which the number exceeds said predetermined number are stacked on said first tray, said controller does not drive said transfer unit even if the sheets of which the number corresponds to said predetermined number are stacked on said first tray, but drives said transfer unit in accordance with that the last page of said group is stacked on said first tray.

19. A sheet process device comprising:

a stagnator for stagnating received sheets;

a first tray for stacking thereon the sheets;

a carrier for carrying the sheets to said first tray without stagnating them in said stagnator, and carrying the sheets to said first tray after stagnating them in said stagnator;

a second tray for stacking thereon the sheets transferred from said first tray;

a transfer unit for transferring the sheets from said first tray to said second tray; and a controller for driving said transfer unit in accordance with a predetermined number of sheets stacked on said first tray and that a last sheet of one group is stacked on said first tray, and for controlling said carrier to cause said stagnator to stagnate the sheets when said transfer unit transfers the sheets, wherein said controller drives said transfer unit when a third to last sheet of the group is stacked on said first tray, even if the predetermined number of sheets are not stacked on said first tray.

20. A sheet process device comprising:

a stagnator for stagnating sheets received;

a first tray for stacking thereon the sheets;

a carrier for carrying the sheets to said first tray without stagnating them in said stagnator, and carrying together with newly received sheets to said first tray after stagnating at least one of the sheets in said stagnator;

a second tray for stacking thereon the sheets transferred from said first tray;

a transfer unit for transferring the sheets from said first tray to said second tray; and a controller for driving said transfer unit when a predetermined number of sheets are stacked on said first tray and a last sheet of one group is stacked on said first tray, and for controlling said carrier to cause said stagnator to stagnate the sheets when said transfer unit transfers the sheets, wherein said controller drives said transfer unit in accordance with that any one of sheets from a (B+2)-th last sheet to a third to last sheet of the group is stacked on said first tray, even if the predetermined number of sheets are not stacked on said first tray.

21. A sheet process device comprising:

a stagnator for stagnating received sheets;

a first tray for stacking thereon the sheets;

a carrier for carrying the sheets to said first tray without stagnating them in said stagnator, and carrying the sheets together with newly received sheets to said first tray after stagnating at least one of the sheets in said stagnator;

a second tray for stacking thereon the sheets transferred from said first tray;

a transfer unit for transferring the sheets from said first tray to said second tray; and a controller for driving said transfer unit when a predetermined number of sheets are stacked on said first tray and a last sheet of one group is stacked on said first tray, and for controlling said carrier to cause said stagnator to stagnate the sheets in accordance with that the predetermined number of sheets are stacked on said first tray and that the last sheet of the group is stacked on said first tray, wherein said controller controls said carrier to cause said stagnator to stagnate at least a second last sheet of the group, even if the predetermined number of sheets are not stacked on said first tray.

22. An image forming apparatus comprising:

an image forming unit for forming an image on a sheet;

a first tray for stacking thereon sheets transferred from said image forming unit;

a binder for performing a binding process on the sheets stacked on said first tray;

a second tray for stacking thereon the sheets transferred from said first tray;

a transfer unit for transferring the sheets from said first tray to said second tray; and a controller for driving said transfer unit in accordance with a last sheet of one group is stacked on said first tray, wherein, in a mode not to perform the binding process by said binder, when the sheets of a group composed of the sheets of which the number exceeds said predetermined number are stacked on said first tray, even if the last page of said group is not stacked on said first tray, said controller drives said transfer unit in accordance with the sheets of which the number corresponds to said predetermined number being stacked on said first tray, and in a mode to perform the binding process by said binder, when the sheets of a group composed of the sheets of which the number exceeds said predetermined number are stacked on said first tray, said controller does not drive said transfer unit even if the sheets of which the number corresponds to said predetermined number are stacked on said first tray, but drives said transfer unit in accordance with the last page of said group being stacked on said first tray.

23. An image forming apparatus comprising:

an image forming unit for forming an image on a sheet;

a stagnator for stagnating sheets transferred from said image forming unit;

a first tray for stacking thereon the sheets;

a carrier for carrying the sheets to said first tray without stagnating them in said stagnator, and carrying the sheets to said first tray after stagnating them in said stagnator;

a second tray for stacking thereon the sheets transferred from said first tray;

a transfer unit for transferring the sheets from said first tray to said second tray; and a controller for driving said transfer unit in accordance with a predetermined number of sheets stacked on said first tray and a last sheet of one group being stacked on said first tray, and for controlling said carrier to cause said stagnator to stagnate the sheets when said transfer unit transfers the sheets, wherein said controller drives said transfer unit when a third to last sheet of the group is stacked on said first tray, even if the predetermined number of sheets are not stacked on said first tray.

24. An image forming apparatus comprising:

an image forming unit for forming an image on a sheet;

a stagnator for stagnating B sheets transferred from said image forming unit;

a first tray for stacking thereon the sheets;

a carrier for carrying the sheets to said first tray without stagnating them in said stagnator, and carrying together with newly received sheets to said first tray after stagnating at least one of the sheets in said stagnator;

a second tray for stacking thereon the sheets transferred from said first tray;

a transfer unit for transferring the sheets from said first tray to said second tray; and a controller for driving said transfer unit when a predetermined number of sheets are stacked on said first tray and a last sheet of one group is stacked on said first tray, and for controlling said carrier to cause said stagnator to stagnate the sheets when said transfer unit transfers the sheets, wherein said controller drives said transfer unit in accordance with any one of sheets from a (B+2)-th last sheet to a third to last sheet of the group being stacked on said first tray, even if the predetermined number of sheets are not stacked on said first tray.

25. An image forming apparatus comprising:

an image forming unit for forming an image on a sheet;

a stagnator for stagnating sheets transferred from said image forming unit;

a first tray for stacking thereon the sheets;

a carrier for carrying the sheets to said first tray without stagnating them in said stagnator, and carrying the sheets together with newly received sheets to said first tray after stagnating at least one of the sheets in said stagnator;

a second tray for stacking thereon the sheets transferred from said first tray;

a transfer unit for transferring the sheets from said first tray to said second tray; and a controller for driving said transfer unit when a predetermined number of sheets are stacked on said first tray and a last sheet of one group is stacked on said first tray, and for controlling said carrier to cause said stagnator to stagnate the sheets in accordance with the predetermined number of sheets being stacked on said first tray and the last sheet of the group being stacked on said first tray, wherein said controller controls said carrier to cause said stagnator to stagnate at least a second last sheet of the group, even if the predetermined number of sheets are not stacked on said first tray.

* * * * *

UNITED STATES PATENT AND TRADEMARK OFFICE

CERTIFICATE OF CORRECTION

PATENT NO. : 6,517,065 B2 
DATED : February 11, 2003
INVENTOR(S) : Norifumi Miyake et al.

It is certified that error appears in the above-identified patent and that said Letters Patent is hereby corrected as shown below:

Column 26,
Line 17, "stack," should read -- stack --.

Signed and Sealed this

Twenty-sixth Day of August, 2003

JAMES E. ROGAN
*Director of the United States Patent and Trademark Office*